US011115746B1

(12) United States Patent
Morrison et al.

(10) Patent No.: US 11,115,746 B1
(45) Date of Patent: Sep. 7, 2021

(54) DYNAMIC LATCHING OF HINGED DEVICES

(71) Applicant: Apple Inc., Cupertino, CA (US)

(72) Inventors: Scott D. Morrison, Austin, TX (US); Kirill Kalinichev, San Francisco, CA (US); Ali N. Ergun, Sunnyvale, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/032,602

(22) Filed: Sep. 25, 2020

(51) Int. Cl.
*H04R 1/10* (2006.01)

(52) U.S. Cl.
CPC ..... *H04R 1/1025* (2013.01); *H04R 1/1016* (2013.01)

(58) Field of Classification Search
CPC ..... H04R 1/1025; H04R 1/1016
USPC ..... 381/394
See application file for complete search history.

(56) References Cited

U.S. PATENT DOCUMENTS 8,903,519 B2 12/2014 King et al.
10,097,913 B2 10/2018 Zorkendorfer et al.
10,206,474 B2 2/2019 Brzezinski et al.
10,750,268 B2 8/2020 Dang et al.
2015/0230036 A1* 8/2015 Pedersen ..... H04R 25/305 381/330
2016/0173991 A1* 6/2016 Mima ..... H04R 1/028 381/333
2017/0215293 A1* 7/2017 Merenda ..... A45C 13/02
2018/0262826 A1* 9/2018 Ingram ..... H04B 1/3888

* cited by examiner

*Primary Examiner* — Sean H Nguyen
(74) *Attorney, Agent, or Firm* — Kilpatrick Townsend & Stockton

(57) ABSTRACT

A charging case for a pair of earbuds that comprises: a body having one or more cavities configured to receive the pair of earbuds; a lid attached to the body and operable between a closed position where the lid is aligned over the one or more cavities covering the pair earbuds and an open position that allows a user to remove the pair of earbuds from the body; one or more sensors that generates sensor data; a controller coupled to receive the sensor data from the sensor and operable to detect when the charging case is in freefall and/or suffers an impact event based, at least in part, on the sensor data and generate a trigger signal in response to detecting the impact event; and an earbud protection mechanism responsive to the trigger signal and operable to retain the pair of earbuds within the charging case.

20 Claims, 10 Drawing Sheets

DYNAMIC LATCHING OF HINGED DEVICES

BACKGROUND

The described embodiments relate generally to portable listening devices, such as earbuds and other types of in-ear listening devices, and to cases for storing and charging such devices.

Earbuds and other portable listening devices can be used with a wide variety of electronic devices such as portable media players, smart phones, tablet computers, laptop computers and stereo systems among others. Many currently available earbuds and portable listening devices are wireless devices that do not include a cable and instead, wirelessly receive a stream of audio data from a wireless audio source.

While wireless portable listening devices have many advantages over wired devices, they also have some potential drawbacks. For example, wireless earbuds typically require a battery, such as a rechargeable battery, that provides power to the wireless communication circuitry and other components of the earbuds. For many currently available wireless earbuds, charge can be restored to the rechargeable battery of the earbuds by placing the earbuds in a charging case that is specifically designed to both store and charge the earbuds.

The charging case typically includes a lid that can be opened and closed to reveal an interior cavity that has a preformed shape specifically designed to match the contours of the earbuds. The lid can be held shut by a magnet, a latch or a similar mechanism and a user can place the earbuds in the case and remove the earbuds from the case by opening the lid. For an ideal user-experience, the lid should open easily with a relatively light touch when needed but otherwise stay closed, including when the charging case is mishandled. Typical charging cases include a lid retention mechanism, such as a magnet or spring detent, that preloads a predetermined force selected to balance these two competing criteria.

Sharp impact events, however, such as if the case is accidentally dropped onto a hard surface, can overwhelm the preloaded force causing the lid to open. Such events can also result in the earbuds being dislodged from the charging case.

BRIEF SUMMARY

Various embodiments disclosed herein pertain to a charging case for wireless earbuds or other portable listening devices that can detect drop events and/or impact events that can potentially result in the earbuds or other portable listening device from being dislodged from the charging case. Charging cases according to some embodiments can include sensors that can collect motion data (e.g., detect and measure acceleration and/or rotation of the charging case) and/or other data and use the collected data to detect when the charging case is in freefall state that can be indicative of a drop event. Once a drop event is detected or predicted, the charging case can activate an earbud protection mechanism to keep the case lid closed or the earbuds secured within the charging case until after the drop event is over. In various embodiments the earbud protection mechanism can be one or more of: an electromagnetic magnetic lid retention mechanism, an electromechanical latch or similar mechanical lid retention mechanism, an electronically controlled hinge that increases friction at the hinge to keep the lid closed, and/or a mechanism that physically holds the earbuds within the charging case.

In some embodiments, the earbud protection mechanism of the charging case can be a dynamic lid locking mechanism that can be activated during a drop event, or in response to an impact event, to lock (or otherwise increase the retention force on) the lid in the closed position thus preventing the lid from opening and thus preventing the earbuds or other portable listening device from being dislodged from the charging case. The dynamic lid retention mechanism can then release the lock (or release the increased retention force) after the drop event has occurred or is no longer predicted.

In some embodiments, the earbud protection mechanism of the charging case can include a dynamic earbud retention mechanism that can be activated during a drop event or in response to an impact event to retain the earbuds within the charging case even if the drop or impact event causes the lid to open. The earbud retention mechanism can then be deactivated after the drop event has occurred or is no longer predicted so that a user can remove the earbuds from the charging case when desired.

A charging case for a portable listening device in accordance with some embodiments includes: a body defining a recess for storing the portable listening device; a lid operably coupled to the body and operable between a closed position where the lid is aligned over the recess covering the portable listening device and an open position that allows a user to remove the portable listening device from the body; one or more sensors that generate sensor data; a controller coupled to receive the sensor data from the one or more sensors, the controller operable to: (i) detect an event that can lead to the portable listening device being dislodged from the charging case, and (ii) generate a trigger signal in response to detecting the event; and a portable listening device protection mechanism responsive to the trigger signal and operable to retain the portable listening device within the charging case.

In various implementations, the charging case can further include one or more of the following features. The controller can be operable to detect when the charging case is in freefall and the trigger signal can activate the portable listening device protection mechanism and the portable listening device protection mechanism can remain activated until the controller detects that a drop event that caused the freefall is over. The controller can be operable to detect when the charging case is subjected to an impact event and the trigger signal can momentarily activate the portable listening device protection mechanism for a predetermined time period. The portable listening device protection mechanism can be operable to lock the lid to the body during the event. The portable listening device protection mechanism can be operable to impart a force on the portable listening device to secure the portable listening device within the recess during the event. The portable listening device can be a pair of earbuds and the charging case recess can include a first pocket sized and shaped to accept a left earbud in the pair of earbuds and a second pocket sized and shaped to accept a right earbud in the pair of earbuds. The portable listening device protection mechanism can be one or more of an electromagnet, an electropermanent magnet, a mechanical latch or a locking hinge.

In some embodiments a charging case for a pair of earbuds is provided. The charging case can include: a body having one or more pockets configured to receive the pair of earbuds; a lid attached to the body and operable between a closed position where the lid is aligned over the one or more pockets covering the pair earbuds and an open position that allows a user to remove the pair of earbuds from the body;

a motion sensor that generates motion sensor data; a controller coupled to receive the sensor data from the motion sensor, the controller operable to detect when the charging case is in freefall based, at least in part, on the motion sensor data and generate a trigger signal in response to detecting the charging case is in freefall; and an earbud protection mechanism responsive to the trigger signal and operable to retain the pair of earbuds within the charging case.

The earbud protection mechanism can be a dynamic lid retention mechanism configured to lock the lid to the body during the freefall event and, in some instances, the dynamic lid retention mechanism can be a mechanical latch or a locking hinge. The earbud protection mechanism can be a dynamic earbud retention mechanism configured to impart a force on each of the earbuds in the pair of earbuds to secure the earbuds within the cavity during the freefall event and, in some instances, the dynamic earbud retention mechanism can be a spring-activated mechanical component.

In still additional embodiments a charging case for a pair of earbuds can include: a body having one or more cavities configured to receive the pair of earbuds; a lid attached to the body and operable between a closed position where the lid is aligned over the one or more cavities covering the pair earbuds and an open position that allows a user to remove the pair of earbuds from the body; and a sensor that generates sensor data; a controller coupled to receive the sensor data from the sensor and operable to detect when the charging case suffers an impact event based, at least in part, on the sensor data and generate a trigger signal in response to detecting the impact event; an earbud protection mechanism responsive to the trigger signal and operable to retain the pair of earbuds within the charging case.

The earbud protection mechanism can be a dynamic lid retention mechanism configured to lock the lid in response to the trigger signal and, in some instances, the dynamic lid retention mechanism can be an electromagnet. The earbud protection mechanism can be a dynamic earbud retention mechanism configured to impart a force on each earbud in the pair of earbuds in response to the trigger signal to secure the earbuds within the cavity during the impact event and, in some instances, the dynamic earbud retention mechanism can include an electromagnet.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION

Figure 1:
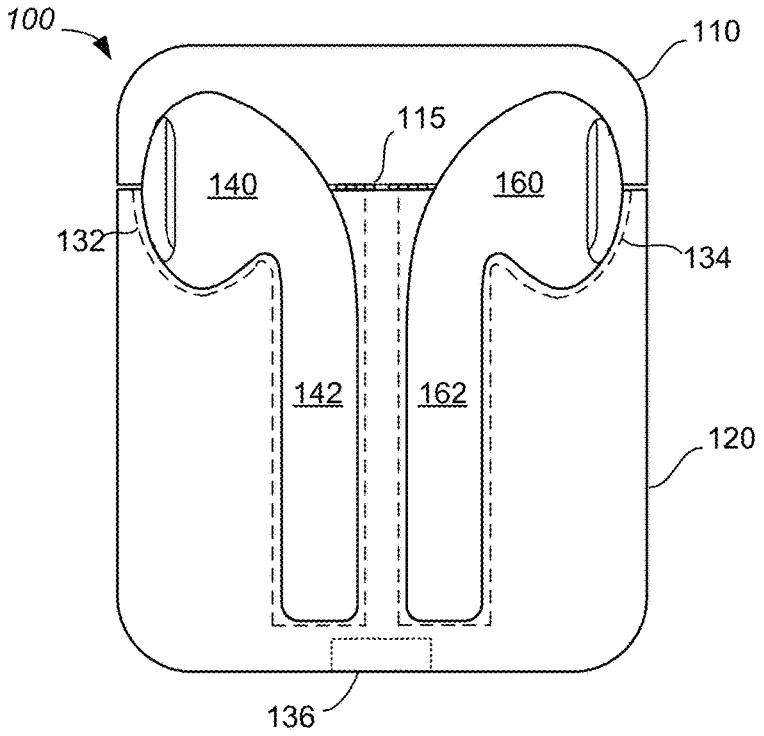
FIG. 1 is a simplified cross-sectional view of an earbud case with its lid closed according to some embodiments of the disclosure.

The present invention will now be described in detail with reference to certain embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known details have not been described in detail in order not to unnecessarily obscure the present invention.

Embodiments disclosed herein pertain to a charging case for wireless earbuds or other portable listening devices that can detect drop events and/or impact events that can potentially result in the earbuds or other portable listening device from being dislodged from the charging case. In order to simplify the description of various embodiments discussed herein, the discussion below repeatedly refers to a charging case for a "pair of earbuds" or a "pair of wireless earbuds". It is to be understood, however, that reference to a charging case for a pair of earbuds is simply a shorthand description for a storage or charging case for any relatively small portable wireless listening device including hearing aids or headphones. Additionally, embodiments of the disclosure can also be incorporated into storage cases for other small electronic devices or even mechanical devices that include a lid and, if dropped, might result in the lid opening and the device stored therein being dislodged from the storage case.

Charging cases according to some embodiments can include one or more sensors that can collect motion data (e.g., detect and measure acceleration and/or rotation of the charging case) and/or other data concerning the physical environment that the charging case is within and/or properties of the charging case relative to that environment. The collected data can be fed to a controller or other type of processor within the charging case to detect when the charging case is in freefall state that can be indicative of a drop event. Once a drop event is detected or predicted (or upon the detection of a hard impact event), the charging case can activate an earbud protection mechanism to keep the case lid closed or to physically secure the earbuds within the charging case until after the drop event is over.

In some embodiments, the earbud protection mechanism of the charging case can be a dynamic lid locking mechanism that can be activated during a drop event to lock (or otherwise increase the retention force on) the lid in the closed position thus preventing the lid from opening and thus preventing the earbuds or other portable listening device from being dislodged from the charging case. The dynamic lid retention mechanism can then release the lock (or release the increased retention force) after the drop event has occurred or is no longer predicted. In other embodiments the earbud protection mechanism of the charging case can be a dynamic lid locking mechanism that can be momentarily activated upon detecting a hard impact event to immediately lock (or otherwise increase the retention force on) the lid in the closed position at the time of impact thus preventing the lid from opening and thus preventing the earbuds or other portable listening device from being dislodged from the charging case. The lid locking mechanism can be activated in such embodiments for a brief moment and then reactivated as necessary if the drop event results in additional hard impact events.

In some embodiments, the earbud protection mechanism of the charging case can include a dynamic earbud retention mechanism that can be activated during a drop event or in response to an impact event to retain the earbuds within the charging case even if the drop or impact event results in the lid opening. The earbud retention mechanism can physically hold the earbuds within the charging case, for example physically hold each earbud in a pair of earbuds within a pocket of the charging case specifically designed to store the particular earbud, and then be deactivated after the drop event has occurred or is no longer predicted so that a user can remove the earbuds from the charging case when desired.

Example Charging Case

Figure 2:
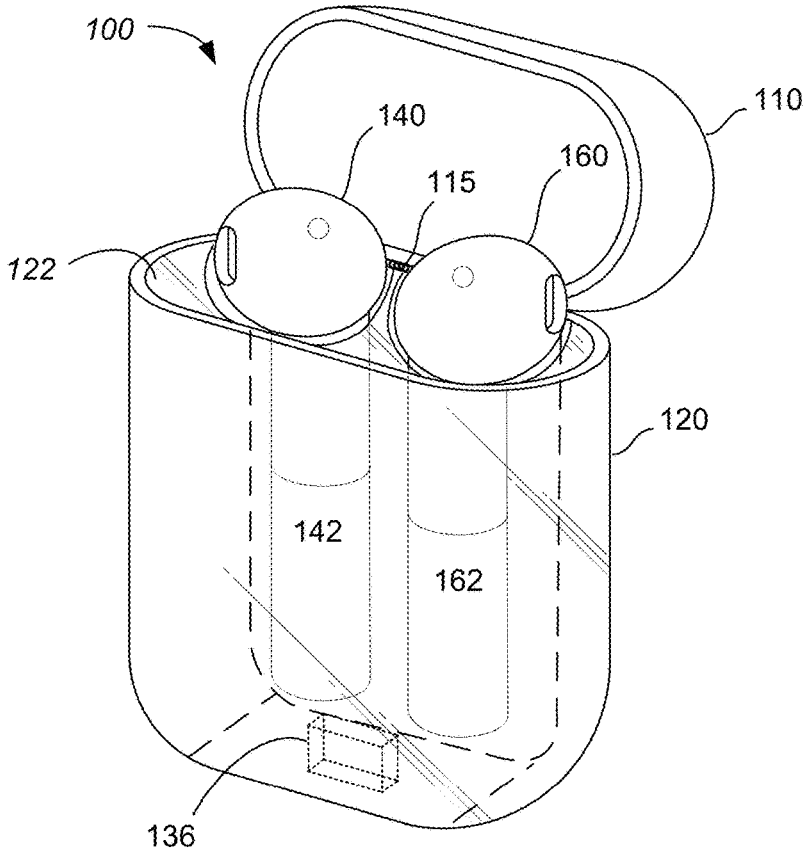
FIG. 2 is a simplified perspective view of the earbud case shown in FIG. 1 with its lid open.

In order to better appreciate and understand the present invention, reference is first made to FIGS. 1 and 2, which depict an example charging case 100. It is to be understood that the description of charging case 100 in FIGS. 1 and 2 is provided for illustrative purposes only and that while charging case 100 represents a specific example of an earbud charging case and a pair of earbuds according to some embodiments, embodiments of the invention are not limited to the specific features of charging case 100 or the particular earbuds stored therein as discussed below.

FIG. 1 is a simplified cross-sectional view of an earbud charging case 100 with a lid 110 closed over a case body 120 according to some embodiments, and FIG. 2 is a simplified see-through perspective view of earbud case 100 with lid 110 in an open position. As shown in FIGS. 1 and 2, earbud case 100 includes a case body 120 and a lid 110 that can be pivotally coupled to body 120 by a hinge 115. Body 120 can include interior space in which a pair of earbuds 140, 160 can be stored.

The interior space of body 120 can define first and second pockets or cavities 132, 134 (shown in FIG. 1) sized and shaped to accept earbuds 140, 160, respectively. In some embodiments, an insert 122 can bonded to and considered a portion of body 120 to form cavities 132, 134. Each of the cavities 132, 134 can then be defined by a surface of the insert 122 that conforms to the general shape of the earbuds 140, 160. For example, insert 122 can define a top surface of body 120 that includes two separate upper contoured recesses each of which is sized and shaped to accept a speaker housing portion of one of the left and right earbuds in the pair of earbuds 140, 160. Insert 122 can further define first and second interior tubular sections, one for each of the left and right earbuds, that extend from the two upper contoured recesses and accept the stems 142, 162 of the left and right earbuds, respectively.

In some embodiments, charging case 100 can further include one or more magnets strategically positioned within the charging case to cooperate with a magnet or magnetic element (e.g., a metal plate) in each earbud such that the earbuds are magnetically held within their respective pockets or cavities. The one or more magnets in the charging case can be selected to impart a sufficient force to secure the earbuds in the case during normal use while still allowing a user to readily remove the earbuds from the case when desired. In balancing these two competing goals, the magnets that secure the earbuds 140, 160 in the case may not be sufficiently strong to ensure that the earbuds are not dislodged from the case in a drop event.

Lid 110 can be coupled to body 120 by a hinge 115 or similar mechanism that enables the lid to be moved between a closed position in which the lid covers the interior space of case 100 including cavities 132, 134 and an open position (illustrated in FIG. 2) in which the cavities are exposed to allow a user to place the earbuds 140, 160 within case 100 or remove the earbuds 140, 160 from the case. While not shown in FIG. 1 or 2, earbud case 100 can also include a battery, charging circuitry to charge the battery and/or charge earbuds 140, 160 stored within the case (e.g., with wired contacts and/or wirelessly), a controller, one or more user input devices, and other circuitry and components, some of which are discussed with respect to FIG. 3 below.

In some embodiments, each of the earbud body 120, lid 110 and insert 122 can be made from a plastic or similar material such as ABS or polycarbonate. Similarly, each earbud 140, 160 can include an earbud housing that defines the size and shape of the earbud and can also be made out of a plastic or similar material, including but not limited to ABS or a polycarbonate. In some embodiments, the housing for each earbud 140, 160 can include a speaker housing portion and a stem portion (e.g., stems 142, 162) that coupled to and extends away from the speaker housing portion. Speaker housing portion can include an audio exit and a speaker can be positioned within the housing and operatively coupled to emit sound through the audio exit. The earbud housing can also include a battery, a wireless antenna, circuitry coupled to receive a wireless signal over the antenna, and other components positioned within either the speaker housing portion or the stem portion and protected by the earbud housing.

Case 100 can also include a receptacle connector 136 that has an opening at an exterior surface of case 100 (e.g., the bottom surface as shown in FIG. 1). A suitable plug connector can be inserted in the opening to mate with the receptacle connector and transfer power to case 100 (e.g., from a charging cable) to charge a battery (not shown) within case 100 and/or to transfer data between case 100 and another device. Receptacle connector 136 can be, for example, a mini-USB connector, a Lightning connector developed by Apple Inc., the assignee of the present application, a USB-C connector, or any other appropriate connector. In other embodiments, connector 136 is optional and case 100 can instead receive power to charge an internal battery from a wireless power source (not shown) and also wirelessly exchange data with a host or other device. For example, in some embodiments case 100 can include one or more wireless power receiving coils that can wirelessly receive power from one or more wireless power transmit coils within a wireless charging puck, charging mat or similar device. Additionally, in some embodiments case 100 can include a wireless transceiver to wirelessly send and receive data using a Bluetooth or other appropriate interface.

Block Diagram

Figure 3:
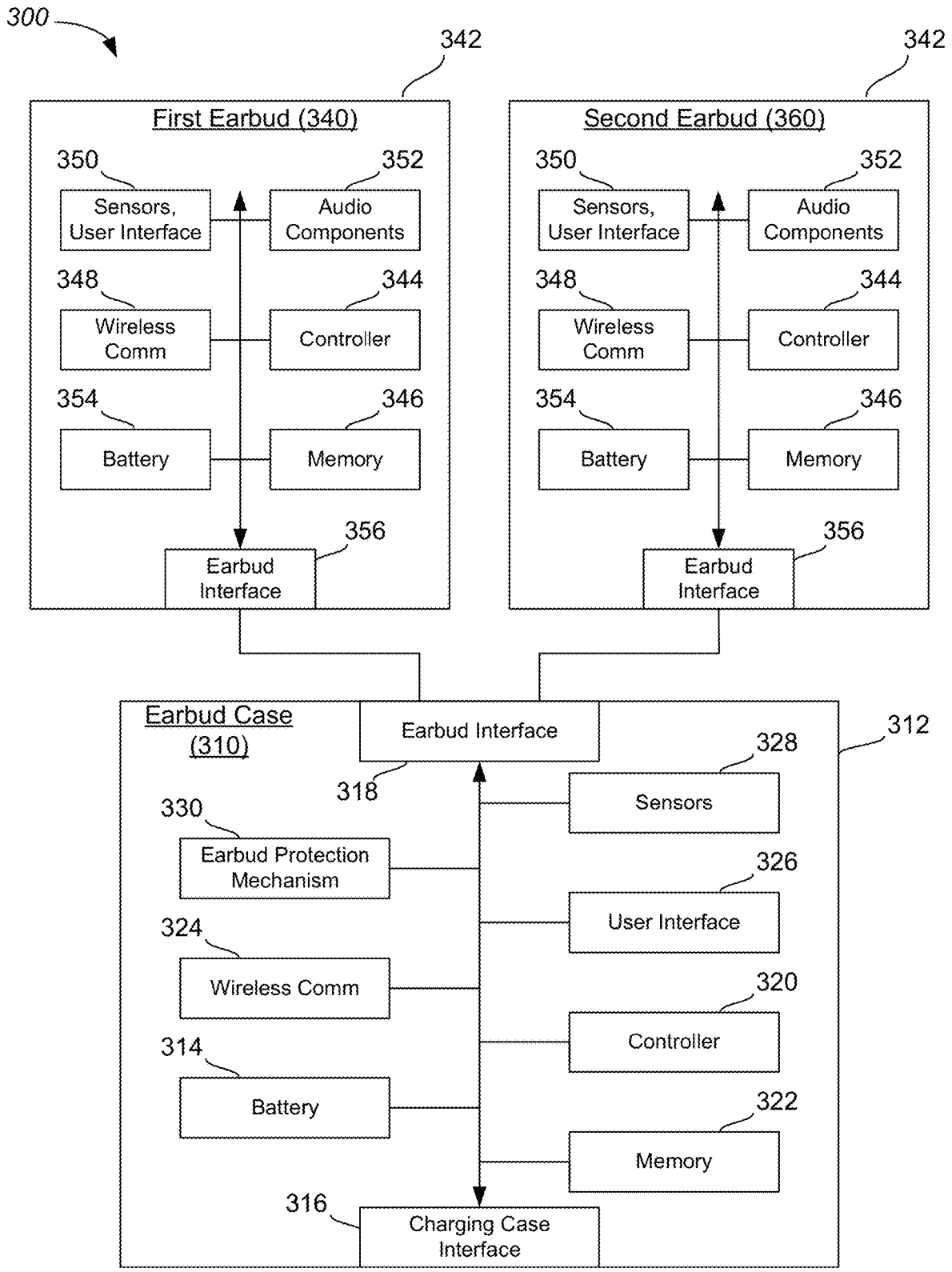
FIG. 3 is simplified block diagram of certain components within a portable wireless listening device system according to some embodiments.

FIG. 3 is a block diagram illustrating a portable electronic listening device system 300 according to some embodiments of the present disclosure that includes a charging case 310 and a pair of earbuds 340, 360. Charging case 310 can be representative of charging case 100 and earbuds 340, 360 can be representative of earbuds 140, 160. Charging case 310 can include a housing 312 that stores and protects the earbuds 340, 360 as well as the various internal components of the charging case. Housing 312 can be, for example, a combination of body 120 and lid 110 discussed above with respect to FIGS. 1 and 2.

Charging case 310 can include a battery 314, which can be any suitable energy storage device, such as a lithium ion battery, capable of storing energy and discharging stored energy to operate the charging case. The discharged energy can be used to power the electrical components of charging case 310 and to charge the pair of earbuds 340, 360. Battery 314 can also be coupled to an earbud interface 318 to provide power to recharge batteries in either or both of earbuds 340, 360. In various embodiments the earbud interface 318 can wirelessly transmit power to the earbuds 340, 360 or can transmit power over a wired interface (e.g., through a physical contacts disposed in the charging case and on the earbuds).

In some embodiments, battery 314 can also be charged to replenish its stored energy. For instance, battery 314 can be a rechargeable battery coupled to a charging case interface 316 that can include power receiving circuitry. The power receiving circuitry can electrically couple to a power transmitter to receive current from a charging device (not shown). In various embodiments the power receiving circuitry can wirelessly receiver power from the power transmitter, can receive power over a wired interface (e.g., through a physical connector, such as connector 136 shown in FIGS. 1 and 2) and/or can receive power either wirelessly or via a wired interface.

Charging case 310 can include a controller 320 coupled to a computer-readable memory 322. Controller 320 can execute instructions stored in memory 322 for performing functions that can be carried out by the charging case 310. Controller 320 can be one or more suitable computing devices, such as microprocessors, microcontrollers, computer processing units (CPUs), ASICs, graphics processing units (GPUs), field programmable gate arrays (FPGAs), and the like for operating charging case 310. Similarly, computer-readable memory 322 can be one or more memory units, such as read only memory (ROM) units, random access memory (RAM) units, programmable read only memory (PROM) units, and the like. In some embodiments computer-readable memory 322 can be part of the same integrated circuit as some or all of the circuitry that makes up controller 320 while in other embodiments the computer-readable memory 322 can be one or more separate integrated circuit chips.

Controller 320 can also be operatively coupled to, among other elements, a wireless communication system 324, a user interface 326, various sensors 328, and an earbud protection mechanism 330. Wireless communication system 324 can include an antenna and a wireless transceiver for wirelessly receiving and transmitting data to a host electronic device or any other appropriate electronic device. Wireless communication system can implement any appropriate wireless communication protocol(s) and in some embodiments can implement one or more of a WiFi protocol or a Bluetooth protocol to exchange data/commands with an appropriate communication system of a host or other electronic device. User interface 326 can include input and/or output devices. For example, user interface 326 can include one or more LEDs for providing indications of certain operations performed by the charging case (e.g., whether battery 314 is being charged, or whether wireless communication system 324 is wirelessly exchanging data with another device), an input button or touch interface that enables a user to activate one or more features of the charging case (e.g., to initiate wireless pairing of the earbuds with a host device), an active driver (e.g., a speaker) for outputting audible sounds to a user for notification purposes, a microphone for receiving sound from the environment, and any other suitable input and/or output device.

Sensors 328 can include motion sensors (e.g., an accelerometer, a gyroscopic sensor and the like), distance or position sensors (e.g., radar, lidar, ultrasonic, and the like), location sensors (e.g., global position system, compass), image sensors (e.g., one or photodetectors, a CCD image sensor or a CMOS image sensor), shock sensors, magnetic sensors (e.g., a hall effect sensor and/or magnetometer), sound or audio sensors (e.g., speakers, microphones) which can be used as a sonar combination, and any other type of sensor that can measure a parameter of an external entity and/or environment that the charging case 310 is positioned within. The sensors 328 can be in communication with the controller 320 and can provide input to the controller (e.g., one or more signals indicative of measurements from the sensors). In some embodiments the input provided by sensors 328 to controller 320 enable the controller to predict or determine whether the charging case 310 is in a freefall position, how fast the charging case device 100 is falling, and/or how far away (or how much time) until a predicted impact event. In some embodiments the input provided by sensors 320 can also enable (or can instead enable) the controller to determine when charging case 310 experienced an impact event that could potentially result in one or more of the earbuds 340, 360 being dislodged from the charging case. The sensors 328 can be positioned substantially anywhere on or within the charging case 310 and can include a single sensor 328 or multiple sensors 328.

Charging case 310 can also include an earbud protection mechanism 330 that can be activated by controller 320 when the controller predicts or detects a freefall event or when the controller detects an impact event. In some embodiments the earbud protection mechanism 330 can be a dynamic lid locking device that can be activated by controller 320 to lock the lid during a freefall event or immediately upon the detection of an impact event in order to prevent the earbuds from being dislodged from the charging case. In other embodiments the earbud protective mechanism can be an earbud retention mechanism that dynamically secures the earbuds within the charging case thus preventing the buds from being dislodged during a drop event. In still other embodiments, the earbud protection mechanism can be both a dynamic lid locking device and an earbud retention mechanism. The earbud protection mechanism can be any of the devices described below with respect to FIGS. 8A to 12B, such as the dynamic lid locking devices described with respect to FIGS. 8A to 10D or the earbud retention devices described with respect to FIGS. 11A to 12B.

According to some embodiments of the present disclosure, each earbud (or other type of wireless listening device) 340, 360 can include a housing 342 that houses the internal components of the earbud. In some embodiments, housing 342 can be formed of a monolithic outer structure that includes a speaker housing portion and a stem that extends away from the speaker housing portion. Embodiments of the disclosure are not limited to any particular form factor, however, of the earbuds 340, 360. Within housing 342, each earbud can include a controller 344, a computer-readable memory 346, wireless communication circuitry 348, one or more sensors and/or user interface components 350, audio components 352 and a battery 354. The battery 354 can provide power to the circuitry and electrical components within the earbud, and an earbud interface 356 can couple each earbud to the charging case 310 to enable the earbuds to receive an electrical charge from the charging case to recharge the battery 354.

Controller 344 can execute instructions stored in memory 346 for performing functions that can be carried out by the earbud including converting streams of audio data received digitally via the wireless communication circuitry 348 to signals that drive the audio components 352 to output the desired audio content. Controller 344 can be one or more suitable computing devices, such as microprocessors, microcontrollers, central processing units (CPUs), ASICs, graphics processing units (GPUs), field programmable gate arrays (FPGAs), and the like for operating the earbud. Similarly, computer-readable memory 346 can be one or more memory units, such as read only memory (ROM) units, random access memory (RAM) units, programmable read only memory (PROM) units, and the like. In some embodiments computer-readable memory 322 can be part of the same integrated circuit as some or all of the circuitry that makes up controller 344 while in other embodiments the computer-readable memory can be one or more separate integrated circuit chips.

The audio components 352 can include at least one audio driver, such as an active speaker, and one or more microphones. The microphones can be used to pick up voice commands or voice streams from a user of the earbuds that can then be transmitted to a host device via the wireless communication circuitry and, in some embodiments, can be used for active noise cancellation. In some embodiments that include multiple microphones, the microphones can be positioned at different locations on housing 342 strategically chosen to maximize sound capture and/or to improve noise cancellation capabilities of the earbuds 340, 360.

The wireless communication circuitry 348 can include a wireless radio that can be both an input and an output device. The wireless radio can enable the earbuds to receive an audio signal from a host device (e.g., a smart phone, a tablet computer, a laptop computer, a television or the like) that can then be played back over the audio driver under the coordination of controller 344. In some embodiments one or more of earbuds 340, 360 can include a radio that can also transmit an audio signal such as a microphone signal from one or more of the earbuds. In yet further embodiments, one or more of earbuds 340, 360 can include a radio that can transmit communication signals that can command the receiving device (e.g., a host device such as a smartphone) to perform one or more functions such as, but not limited to, connect a phone call, disconnect a phone call, pause audio playback, fast forward or rewind audio playback or mute a microphone signal. The wireless radio can employ any short range, low power communication protocol such as Bluetooth®, low power Bluetooth®, or Zigbee among protocols.

The sensor and user interface components 350 can include one or more buttons or a touch sensor that registers a user's touch and can be activated, for example, by a user to answer a cell phone call, change the volume of earbud speaker, and/or to advance or replay tracks in a playlist. In some embodiments the buttons or touch sensor can also be used to command earbuds 340, 360 to enter a pairing mode that can be indicated, for example, by an LED or similar light that is part of user interface components 350 on either or both earbuds. The sensor and user interface components 350 can also include one or more motion sensors (such as an accelerometer, gyroscope or the like) or other sensors that can detect whether the earbud is in a freefall condition.

The Earbuds 340, 360 can communicate digitally with the charging case 310 by way of the earbud interfaces 356 in the earbuds and the earbud interface 318 in the charging case. In some embodiments, when either or both of earbuds 340, 360 are positioned within the earbud case 310, the sensor components 350 can provide sensor data to the controller 320 in earbud case 310 through these earbud interfaces. In such embodiments, data from sensor components 350 can be relied upon by controller 320 in addition to, or instead of, data from sensors 328 in predicting or determining that the earbud case 310 is in a free fall state or incurred an impact event. Keeping the earbuds 340, 360 ON when the earbuds are stored in the charging case requires energy from either the earbud batteries 354 or the charging case battery 314. To save battery power, in some embodiments where signals from one or more of the sensors 350 can be used by controller 320 to predict or detect a drop event or detect an impact event, the earbuds 340, 360 can be placed in a low power or sleep state where only components that are necessary to operate the particular sensors that send data to controller 320 are in an active states. In other embodiments, the earbuds can be placed in a deep sleep state where the sensors 350 are inactive and the earbuds require only nominal power when the earbuds are stored in charging case 310 and the case is at rest (e.g., as determined by the sensors 328 in the charging case). If one or more of the sensors 328 detect that the charging case is being handled by a user (e.g., moved in any direction), the charging case can send a signal to the earbuds 340, 360 to wake one (or both) of the earbuds up and set the earbud in a low power state in which the sensor is active so that data from the sensor 350 can be received by controller 320 to help the controller detect a drop or impact event.

Example Drop Event

Figure 4A:
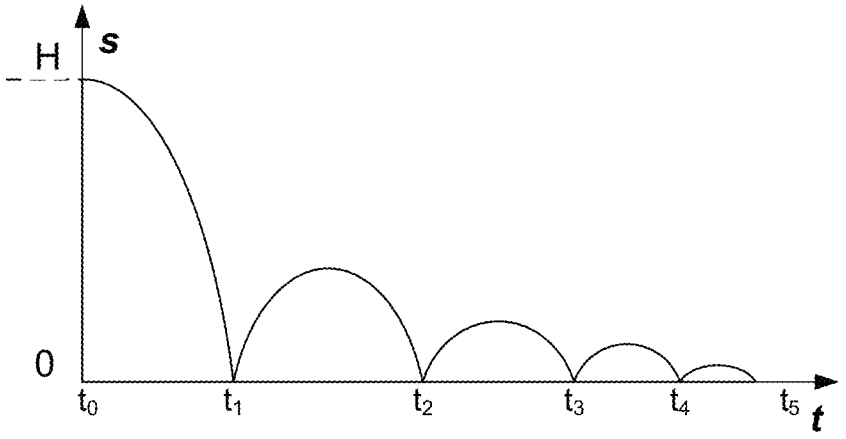
FIG. 4A is a graphs illustrating a typical drop event that can result in one or more earbuds of a charging case being dislodged from the case.
Figure 4B:
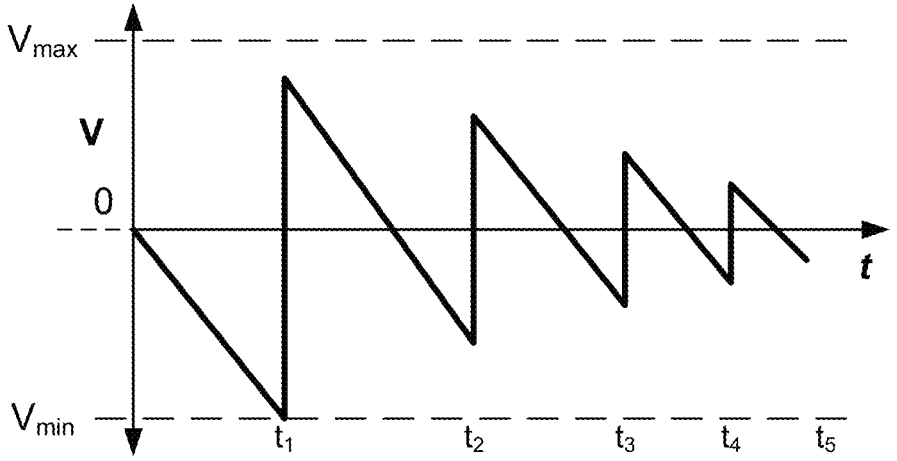
FIG. 4B is a graph showing the velocity of a charging case as it undergoes the drop event depicted in FIG. 4A.
Figure 4C:
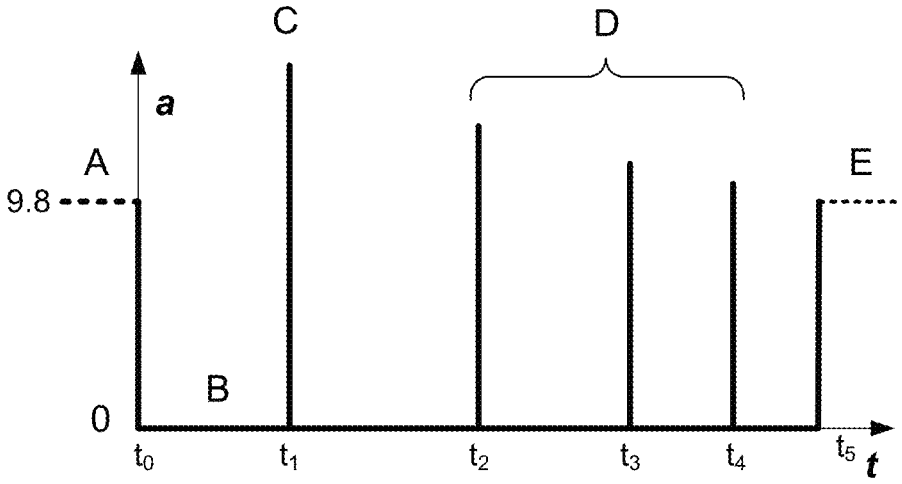
FIG. 4C is a graph depicting acceleration forces, as measured by an accelerometer, that a charging case might be subject to during the drop event depicted in FIG. 4A.

The sensors 328 in charging case 310 (and/or the sensors 350 in one or both of earbuds 340, 360) can generate sensor data from their environment that can be used by controller 320 to predict or detect a drop or similar freefall event and/or to detect a hard impact event—any of which can result in one or both of the earbuds being dislodged from the charging case. To illustrate events that can occur, and example sensor readings that can be generated during, a typical drop event, reference is made to FIGS. 4A-4C. Specifically, FIG. 4A is a graph that plots the height of a charging case over time (t) as it is dropped from a height of H onto a hard surface (height=0), such as a wood or tile floor; FIG. 4B depicts the velocity at which the charging case moves during the drop event illustrated in FIG. 4A; and FIG. 4C depicts the acceleration force (e.g., as measured by an accelerometer) that the charging case is subject to during the drop event during the drop event depicted in FIG. 4A. The data in each of the graphs 4A-4C is plotted along the same time line such that the events shown in FIG. 4A are synchronized (along the X-axis, which represents elapsed time during the drop event, in each of FIGS. 4A-4C) with the events shown in FIGS. 4B and 4C.

As shown in FIGS. 4A-4C, prior to a drop event (time period A, shown in FIG. 4C), the charging case can be subject to arbitrary motion and or acceleration as it is carried by a user. When the charging case is at rest, the velocity of the case is essentially zero (FIG. 4B) and the nominal force on the case can be approximately equal to the force of gravity (1G or 9.8 m/see) upwards as shown in FIG. 4C. During the initial freefall phase of a drop event (time period B), as the charging case is dropped from a height, H, (at time to) towards the floor, the velocity of the charging case increases (FIG. 4B) and the gravity force is reduced to essentially zero as gravity acts on the charging case to pull it downwards (FIG. 4C). Once the case hits the floor (time $t_1$), an initial high amplitude pulse can be generated by the (the initial impact event at time C) and the direction of its velocity instantly changes as the charging case bounces off the floor and changes direction from its downward fall to an upward trajectory. The charging case can then bounce one or more times (time period D shown in FIG. 4C, times $t_2$ to $t_4$) resulting in several secondary impact events that are represented by readings from the accelerometer (FIG. 4C) having smaller and smaller amplitudes before finally coming to rest at the end of the drop event (time period E, time $t_5$) when it returns to 1 g acceleration.

Embodiments of the disclosure can use measurements, such as those shown in FIGS. 4A-4C, from motion sensors and/or measurements from other sensors present in the charging case and/or present in the portable listening device stored in the charging case, to predict when the charging case is in a state of freefall and/or to detect when an impact event occurs, such as the impact events that occur at times $t_1$, $t_2$, $t_3$ and $t_4$ shown above. Based on the predictions made, embodiments can dynamically lock the lid of the charging case or activate a mechanism to increase a retention force on each of the left and right earbuds within the charging case to prevent the earbuds device from being dislodged during the impact events.

Two different approaches to protect the portable listening device stored within a charging case are described below with respect to FIGS. 5 and 6. In each approach a controller in the charging case, such as controller 320 discussed above, is operatively coupled to one or more sensors that measure parameters of the environment that the charging case is positioned within. Based on the sensor signals, the controller determines whether or not to generate a trigger signal that can dynamically lock the lid of the charging case or activate an earbud retention mechanism to increase a retention force on the pair of earbuds stored within the charging case. In a first approach, described with respect to FIG. 5, the controller generates a trigger signal when it predicts or detects that the charging case is in a freefall state. The locking or retention mechanism can then be maintained in an active state until the controller determines that the drop event that initiated the freefall state is over and the charging case is at rest. The controller can then deactivates the locking or retention mechanism. In the second approach, described with respect to FIG. 6, the controller monitors the sensor data and detects when the charging case is subject to a hard impact event, such as when the case is dropped and lands on a tile or wooden floor. When a hard impact event is detected, the controller instantaneously generates a trigger signal that can active a lid lock or earbud retention mechanism. Different embodiments can implement either the first or the second approach depending on, among other factors, the response time required to activate the particular lid locking mechanism or the earbud retention mechanism employed in the charging case and the amount of power required to activate and maintain the different mechanisms in a triggered or engaged state.

Example Method—Freefall Prediction

Figure 5:
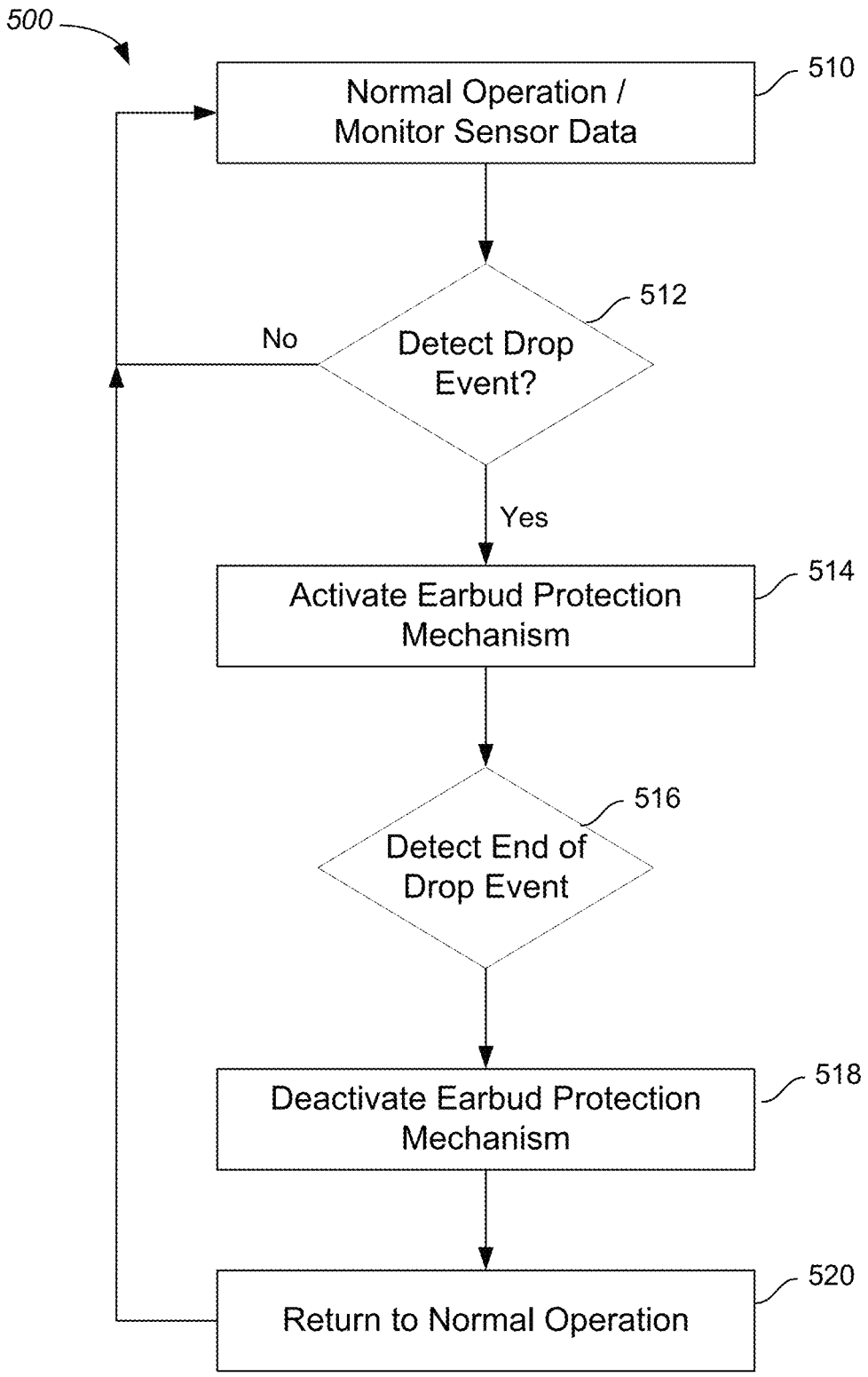
FIG. 5 is a flowchart depicting a method of protecting earbuds during a drop event according to some embodiments of the disclosure.

FIG. 5 is a flowchart depicting steps of a method 500 for preventing an earbud or other portable listening device from being dislodged from a charging case in accordance some embodiments. Method 500 can be carried out by a processor or other type of controller within a charging case, such as controller 320 discussed above. In some embodiments method 500 can be implemented by the controller on an ongoing basis when the charging case is in an ON state. That is, measurements and other readings from sensors of the charging case can be regularly monitored by the controller 320 to predict or detect a potential drop event and action can be taken whenever such measurements meet one or more predetermined criteria that are indicative of freefall or a drop event. Thus, as shown in FIG. 5, method 500 can start with a charging case in a normal operation mode (block 510) in which measurements and other signals from sensors 328 on the charging case (and/or sensors 356 on the earbuds) are monitored by controller 320 of the charging case. In some embodiments, block 510 includes generating sensor data from a motion sensor (e.g., an accelerometer and/or a gyroscope) within the sensors 328 on the charging case and transmitting the sensor data to the charging case controller.

The controller 320 can then evaluate the received sensor data to predict or determine if the received is indicative of a freefall or otherwise indicative of a drop event (block 512). If the controller predicts or determines that the charging case is in freefall, the controller can further evaluate the received sensor data in block 512 to determine if (and when) action should be taken in an attempt to better retain the earbuds within the case by, for example, activating an earbud protection mechanism (block 514). The controller can, in block 514, also determine an optimal or precise time to activate the earbud protection mechanism as set forth below.

In some embodiments, controller 320 can employ an artificial intelligence engine to predict or determine if a charging case is in free fall. The artificial intelligence (AI) engine can be trained over hundreds or thousands or more drop events to recognize the signal characteristics (i.e., measured sensor values) in a drop event. The AI engine can also be trained to distinguish the signal characteristics that are indicative of a minor drop event (e.g., one from a relatively short height) that is unlikely to result in the lid of the charging case opening versus a more serious drop event (e.g., one from a relatively high height) that is likely to result in the lid opening and one or more of the earbuds being dislodged from the charging case. The AI engine can take into account, among other variables, the height at which the charging case is dropped (i.e., the height that freefall is initially detected), the velocity of the charging case as it falls, the amplitude of the accelerometer readings, rotation of the charging case during the fall as measured by a gyroscope, the surface upon which the charging case will fall onto (e.g., a tile or wooden floor versus carpet or grass) and/or other data measured by various sensors during the drop event and/or upon an initial impact of the charging case with a surface and subsequent impacts.

In other embodiments, controller 320 can predict or detect a drop event based on comparing received sensor data to previously measured sensor data that is indicative of a drop event. For example, data from hundreds, thousands or more drop events can be analyzed in a testing environment to select different predetermined criteria of sensor signals received at the controller that have been proven or otherwise demonstrated to be indicative of a drop event and/or impact events that are likely to lead to the one or more earbuds being dislodged from the charging case. Such predetermined measurements can be stored in memory 322 and, in block 512, controller 320 can compare the sensor data it regularly receives with the predetermined threshold(s) of one or more signals that have been previously determined to indicate a drop event. In some embodiments the algorithm can be relatively simple, for example, block 514 can activate the earbud protection mechanism detects that the charging case reaches a velocity greater than X. In other embodiments, the algorithm can be more complex and rely on multiple variables including one or more of: acceleration, rotation, velocity, the surface over which the charging case is dropped (e.g., as determined by a image sensor) and others.

It is worth noting that not all freefall instances are an indication of a drop event. For example, a user may have a habit of repeatedly tossing his or her charging case in the air like a ball or as a juggling exercise. In such instances, and assuming the charging case is caught, the case does not undergo an actual drop event. In some embodiments, with enough training of an appropriate AI routine or enough test data, the controller 320 can distinguish between a number of actions that can cause or simulate freefall that are not an actual drop event and thus do not result in a hard impact. Depending on how accurately the AI routine is trained or how conservatively the drop detection algorithm is programmed, repeatedly tossing a charging case in the air and catching the case will not result in the controller generating a trigger signal.

As stated above, if controller 320 predicts or detects a freefall event (block 512), the controller can generate a trigger signal that activates an earbud protection mechanism within the charging case (block 514). Specific examples of different earbud protection mechanisms are described below with respect to FIGS. 8A-12B.

Figure 7A:
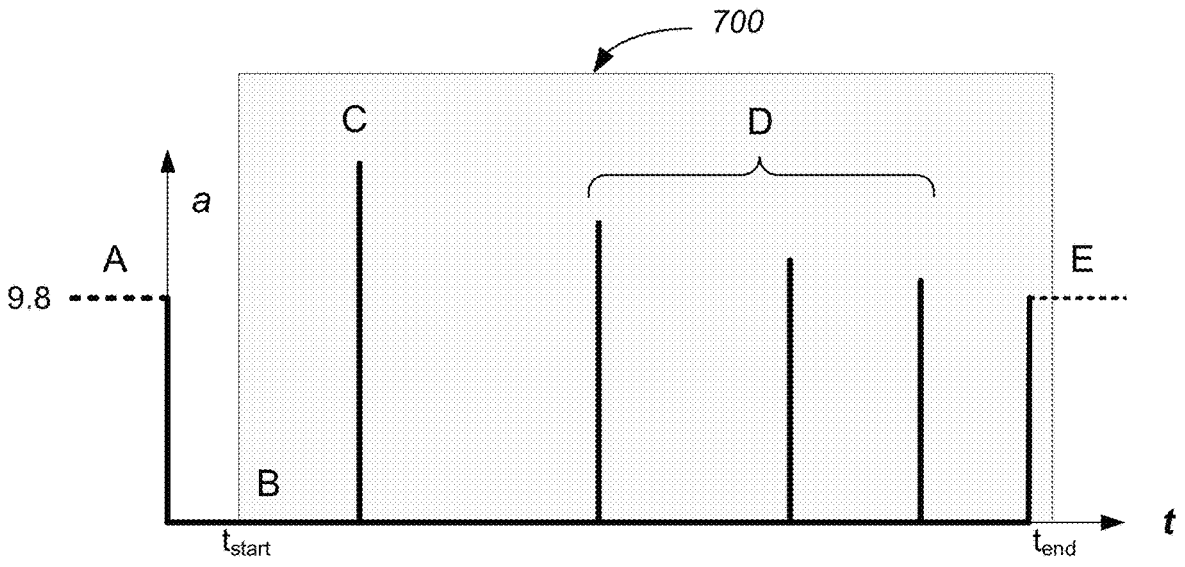
FIG. 7A illustrates an activation period of an earbud protection mechanism during an example drop event according to some embodiments.

In some embodiments, the trigger signal generated by method 500 can activate the earbud protection mechanism for essentially the entire duration of the drop event, from a moment in time when freefall is initially detected prior to the initial impact event to a moment in time when the drop event is over and the charging case has come to rest (block 516). For example, FIG. 7A is a graph that depicts the measurements of the motion sensor shown in FIG. 4C and overlays a time period 700 (represented by the light gray block) that starts at a time, $t_{start}$, and ends at a time, $t_{end}$, during which the earbud protection mechanism is in operation. In some embodiments $t_{start}$ can be the instant that method 500 detects freefall.

In some embodiments, controller 320 can predict when the charging case is going to hit the ground and activate the trigger signal shortly before the predicted impact event. For example, the sensors 356 can include a position sensor that determines the distance to the impact surface and/or the time that it will take the charging case to reach the impact surface at its current rate of fall. The sensors 356 can utilize images, sonar, radar, and so on in order to determine the distance to the ground. If the impact surface is not detected (e.g., if the impact surface is too far away to be determined by the sensor 356), sensor readings can be continuously monitored for a predetermined amount of time allowing the charging case to drop further until the potential impact surface is in range and detected. Thus, block 514 can include a delay time between when freefall is initially detected and when the trigger signal is generated (time $t_{start}$).

In some embodiments, controller 320 can determine the delay time by estimating the time to impact based on the freefall velocity and the distance to the impact surface. The estimated time to impact can then be used by controller 320 to time the generation of the trigger signal. For example, knowing the activation or response time for the particular earbud protection mechanism(s) employed within the charging case, controller 320 can generate the trigger signal at a predetermined time prior to the predicted impact event that is early enough to allow the earbud protection mechanism to be fully activated and engaged at the time of impact. In some instances controller 320 can delay generation of the trigger signal until a point in time when the controller determines that the charging case is within a predetermined distance from the impact surface, for example, within one foot.

In determining the distance to the impact surface it can be helpful to determine the orientation angle of the charging case during freefall. In some embodiments controller 320 can calculate the orientation angle based on input from various ones of the sensors 356. As the charging case may rotate during freefall, the orientation can rapidly change and controller 320 can determine a rotational axis of the charging case as part of the orientation calculation rather than simply a current orientation of the device. Additionally, the orientation determination can include not only the position of the charging case relative to a "normal" position, but also its height in space. For example, the orientation angle may be a three-dimensional vector, e.g., along x, y, and z axis.

In still other embodiments, once freefall is detected a distance to impact (or time to impact) can be automatically determined based on a predetermined value or algorithm. For example, a typical user will carry an earbud charging case at a height between 3-5 feet above the ground. In some embodiments, controller 320 can generate the trigger signal based on a predetermined height at the lower end of this typical range (e.g., at two feet) knowing the drops below the predetermined height are unlikely to result in the lid 110 opening and, if the charging case is dropped from a higher height, activating the earbud protection mechanism early will still protect the earbuds from being dislodged.

After the earbud protection mechanism 330 has been activated, controller 320 can continuously monitor the sensors to determine when the drop event has ended (block 516). For example, when the sensor readings indicate that the earbud charging case has come to rest. Alternatively, in some instances it possible for controller 320 to incorrectly detect or predict a freefall event (block 512), which in turn, can results in the earbud protection mechanism being activated (block 514) unnecessarily. During block 516, sensor data is still continuously being fed into and thus monitored by controller 320. In a false trigger situation such as that just described, the controller 320 can eventually recognize that a freefall event did not occur and that "predicted" drop event is over. Once the controller detects the drop event is over (or that a drop event was incorrectly predicted), the earbud protection mechanism can be deactivated (block 518) and the operation of the charging case returns to normal (block 520), i.e., sensor data is continuously monitored (block 510) to potentially detect the next drop event.

Example Method—Hard Impact Detection

Figure 6:
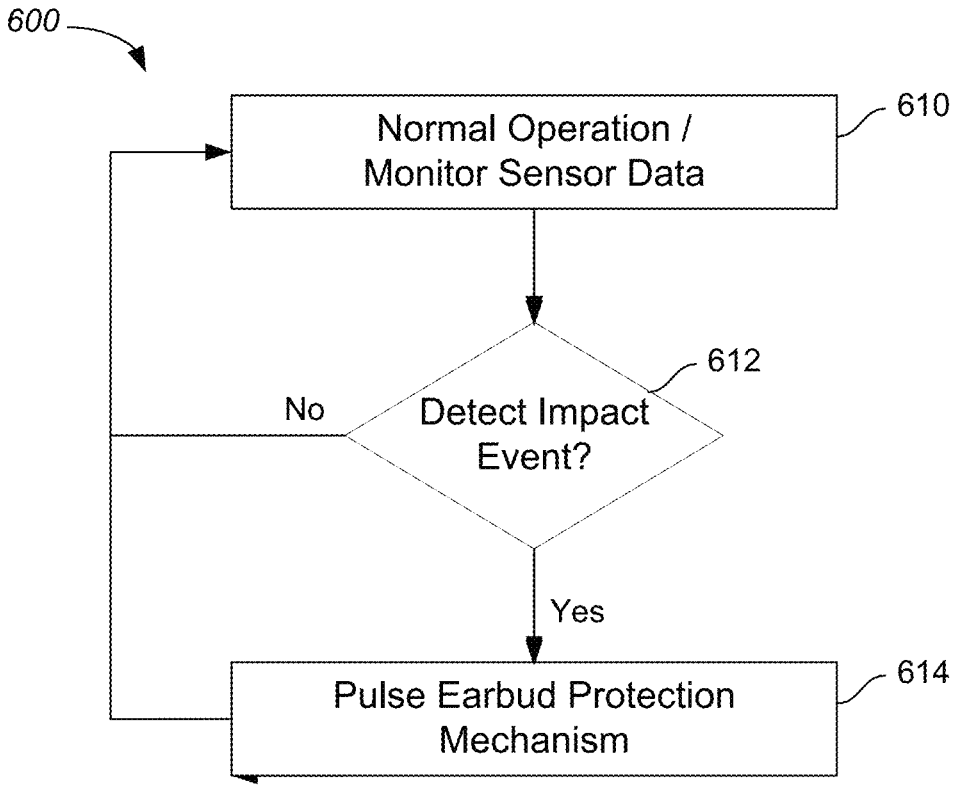
FIG. 6 is a flowchart depicting another method of protecting earbuds during a drop event according to some embodiments of the disclosure.

FIG. 6 is a flowchart depicting steps of a method 600 for preventing a portable listening device from being dislodged from a charging case in accordance additional embodiments. As is the case with method 500, method 6500 can be carried out by a processor or other type of controller within a charging case, such as controller 320 discussed above. Method 600 can be implemented by the controller on an ongoing basis when the charging case is in an ON state such that measurements and other readings from sensors in the charging case can be constantly monitored by the controller 320 to detect a hard impact event so that action can be immediately taken to lessen the potential consequences of such an impact event.

As shown in FIG. 6, method 600 can start with a charging case in a normal operation mode (block 610) in which measurements and other signals from sensors 328 on the charging case (and/or sensors 356 on the earbuds) are monitored by controller 320 of the charging case. In some embodiments, block 610 includes generating sensor data from a motion sensor (e.g., an accelerometer and/or a gyroscope) within the sensors 328 on the charging case and transmitting the sensor data to the charging case controller.

When controller 320 detects a hard impact event (block 612), the earbud protection mechanism(s) of the charging case can be immediately activated (block 614) to prevent the lid from opening and/or to protect the earbuds from being dislodged from the charging case. In some embodiments the activation of the earbud protection mechanism in block 614 is a momentary event that can, for example, be measured in a fractions of a second. For example, if the earbud protection mechanism includes an electromagnet that locks the lid closed or the retains the earbuds in the charging case, block 614 can include pulsing a strong current to the electromagnet for a brief period of time that is sufficient to ensure that the impact event does not open the lid or dislodge the earbuds. The amount of current required to pulse the electromagnet drains a certain amount of energy from the battery 314 of the charging case. Thus, once the impact event is over and the lid is not in immediate danger of opening (and the earbuds are not in immediate danger of being dislodged), the current pulse can be discontinued to save battery power.

The impact detection algorithm in block 612 can include evaluating, by the controller 320, received sensor data to determine if the sensor data is indicative of a hard impact event. Similar to the freefall detection algorithm in method 500, the evaluation can be done using artificial intelligence techniques or can be done based on predetermined thresholds (e.g., an amplitude pulse greater than or equal to X as measured by an accelerometer). As an example, an artificial intelligence routine can be trained over hundreds, thousands, or more drop events to recognize the signal characteristics of a hard impact event that result in the lid of the charging case opening and one or more of the earbuds being dislodged from the case. The algorithm can take into account the height of the fall, the velocity of the charging case as it falls and the amplitude of the accelerometer or other sensors on both an initial impact and subsequent impacts to determine if action should be taken in an attempt to better retain the earbuds within the case. Similarly, data from hundreds, thousands, or more impact events can be analyzed to select different predetermined criteria in the sensor signals received at the controller that have been proven or otherwise demonstrated to be indicative of impact events that are likely to lead to the one or more earbuds being dislodged from the charging case.

Not all impact events are going to result in the lid of the charging case opening and one or more of the earbuds within the case being dislodged. For example, if a charging case is dropped from a relatively short height onto a soft surface, such as carpet or grass, the force and impact to the case will be less than if the case is dropped from a higher height and onto a hard surface, such as a tile or concrete floor. Additionally, how the charging case lands on the surface can also effect the force of the impact event. For example, if the charging case is dropped such that it lands with its flat front or back surface hitting the floor, the lid may be less likely to open than if the case is dropped such that a corner of the charging case hits the floor. In some embodiments the AI or other evaluation algorithm(s) employed by controller 320 can distinguish different types of drop events such as these and only activate the earbud protection mechanisms when impact events occur that are recognized as likely causing the lid to open and one or more of the earbuds to be dislodged.

In still other embodiments, the controller 320 can generate a trigger signal in block 612 only if it detects that the lid of the charging case is actually opening. For example, in some embodiments, the lid can be held in a closed position by a pair of magnets (one in the lid and one in the body). A hall effect sensor can detect and measure the magnetic field generated between the two magnets. Thus, in some embodiments controller 320 can generate a trigger signal if the controller predicts or detects that the charging case is in freefall and then detects that the magnetic field between the lid and body magnets is lessening, which can be indicative of the lid begging to open due to an impact event. Upon detecting that the lid is opening, the controller can activate the earbud protection mechanism to secure the earbuds in the charging case.

Figure 7B:
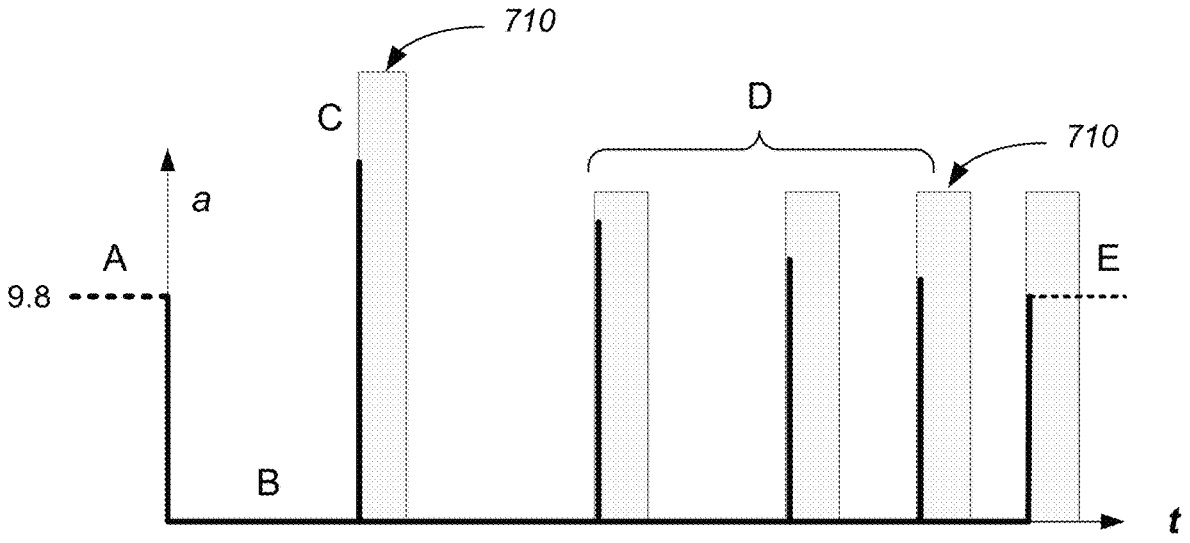
FIG. 7B illustrates multiple momentary activation periods of an earbud protection mechanism during an example drop event according to some embodiments.

In some drop events, the charging case can bounce across the floor creating multiple impact events and thus multiple opportunities for the lid to open. Such a scenario was depicted, for example, in FIGS. 4A-4C discussed above. In some embodiments, method 600 will momentarily active the earbud protection mechanism at each impact instance during a drop event. Thus, as shown in FIG. 7B, method 600 can momentarily activate the earbud protection mechanism event on five separate occasions in response to each of the high amplitude pulses generated by the accelerometer.

Earbud Protective Mechanisms

Methods 500 and 600 discussed above activate an earbud protection mechanism to prevent the earbuds from being dislodged from their charging case in a drop event or other type of situation that causes a hard impact to the charging case. The earbud protection mechanism can be dynamically activated by a controller (e.g., via a trigger signal) to ensure that the earbuds are secured within the charging case during a drop or impact event. As discussed above, the controller can receive one or more input signals from one or more sensors in the case or in one or both of the earbuds stored within the case and use the received input signals to predict or detect a drop event or an actual impact event. In some embodiments the earbud protection mechanism can lock the lid to prevent the lid from opening during a drop event and in some embodiments the earbud protection mechanism can lock the earbuds within charging case so that even if the case lid does open due to the event, the earbuds will remain in the case. Various examples of earbud protection mechanisms according to embodiments of the invention are discussed below in conjunction with FIGS. 8A-12B.

1) Electromagnet Lid Retention

Figure 8A:
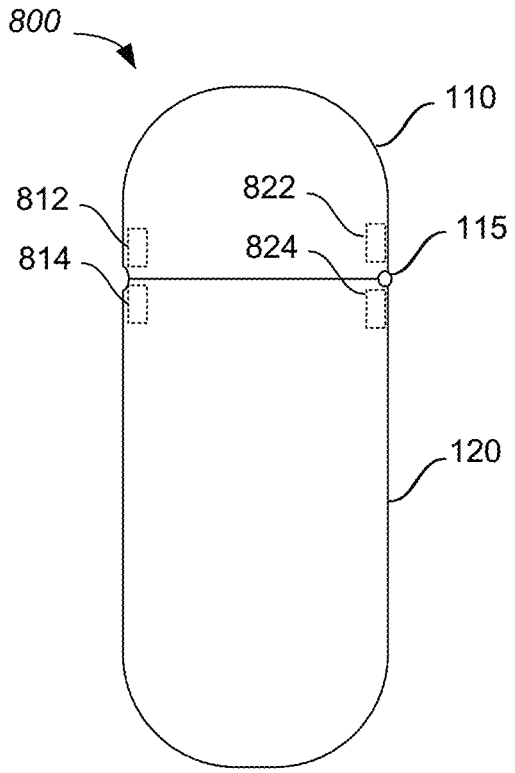
FIG. 8A is a simplified cross-sectional view of a charging case with its lid closed that includes an electromagnetic retention mechanism in accordance with some embodiments.
Figure 8B:
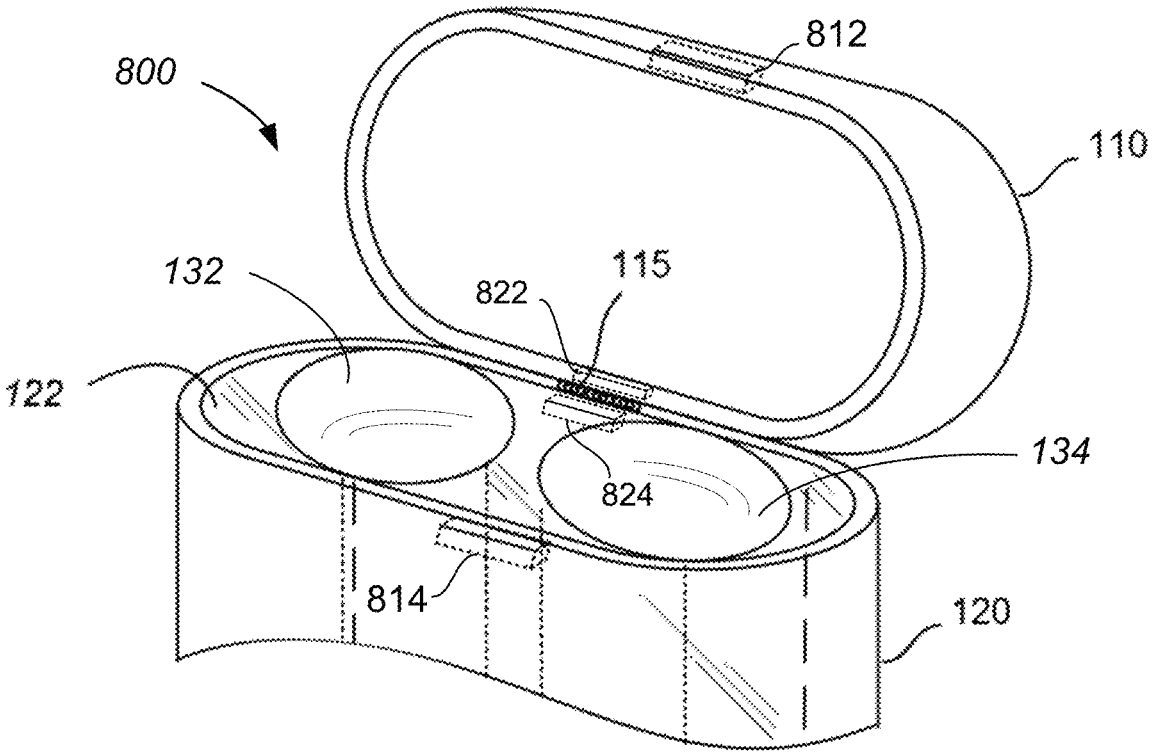
FIG. 8B is a simplified perspective view of a portion of the charging case shown in FIG. 8A with its lid open.

Reference is now made to FIGS. 8A and 8B where FIG. 8A is a simplified cross-sectional view of a charging case 900 according to some embodiments of the disclosure and FIG. 8B is a simplified perspective view of a portion of charging case 900. Charging case 900 can be an implementation of charging case 100 and, for ease of discussion, FIGS. 8A and 8B can include the same references numbers as used in FIGS. 1 and 2 when referring to elements described above with respect to charging case 100. As shown in FIGS. 8A and 8B, charging case 900 can include a lid 110 that is pivotably coupled to a body 120 by hinge 115. Charging case 900 can be designed such that lid 110 can be opened easily by a user with a light touch when desired but otherwise stay closed.

In some embodiments, hinge 115 can be a bi-stable hinge that has two stable states: an open state and a closed state. The bi-stable hinge can have a neutral position where it does not pull to open or close the lid, but once the lid moves in one direction past the neutral position, the bi-stable hinge can either pull the lid open or pull the lid closed. Such a bi-stable design can provide a pleasant user experience and serve to ensure that lid 110 can be easily closed to better protect the earbuds stored within charging case 100.

To keep lid 110 in a closed position, charging case 900 can include a lid retention mechanism that includes a first magnetic element 812 disposed within lid 110 and a second magnetic element 814 disposed within body 120. At least one of the magnetic elements 812, 814 can be a magnet and the other can be either a metal or similar element made of a magnetic material or a second magnet. The magnetic elements 812 and 814 can be positioned along a front portion of the charging case, opposite hinge 115, and aligned with each other such that when lid 110 is closed a magnetic field is generated between the two elements 812, 814 that attracts the two elements to each other and secures the lid 110 in a closed position.

When hinge 115 is a bi-stable hinge, charging case 900 can also include a second set of magnetic elements positioned adjacent to hinge 115 including a magnetic element 822 disposed within lid 110 and a magnetic element 824 disposed within body 120. Magnetic elements 822 and 824 can each be magnets and can be oriented such that they repel one another. Magnetic elements 812, 814, 822 and 824 can be oriented and selected to create an over center configuration for lid 110 where the lid is in a first stable position when in the closed position (illustrated in FIG. 8A) and is in a second stable position when in the open position (illustrated in FIG. 8B), but is in an unstable position in-between the closed position and the open position. In some embodiments this can be achieved by the attractive forces between the pair of magnetic elements 812, 814 over powering the repulsive forces of the pair of magnetic elements 822, 824 when lid 110 is transitioned from the open position to the closed position.

According to embodiments of the disclosure, the lid retention mechanism that keeps lid 110 shut when the lid is in the closed position can be a dynamic lid retention mechanism that includes at least one electromagnet. For example, at least one of magnetic elements 812 or 814 can be an electromagnet that can be activated to increase the magnetic force between the elements 812 and 814 in response to the trigger signal generated by controller 312 as discussed above. As one specific example, magnetic element 814 can include an electromagnet. Thus, during a drop event, a controller, such as controller 320 (not shown in FIG. 8A or 8B), within the charging case can detect the drop event (or detect when the charging case impacts an object, for example, a floor, during a drop event) using any of the techniques described above. Upon detecting such an event, the controller can generate a trigger signal that sends a relatively strong current through a magnetic winding around magnetic element 814 creating a magnetic field between the two magnetic elements 812, 814 that is sufficiently strong to keep the lid 110 closed over the body during the drop event and/or its associated impact events. In some embodiments, current can be momentarily pulsed to the electromagnet (e.g., applied for 5, 10 or 20 milliseconds) only when an impact event is detected as described above with respect to method 600 and shown graphically in FIG. 7B.

In some embodiments, the lid retention component 814 can include a permanent magnet in addition to an electromagnet. The permanent magnet can create a first magnetic field that acts upon lid retention component 812 and is sufficiently strong to secure the lid to the body during normal use (e.g., when the lid is closed by a user). The first magnetic field might not be strong enough to secure lid 110 to body 120 during certain hard impact events, however, such as a drop from five or six feet onto a hard surface. To prevent the lid from opening during such an event, the electromagnet portion of magnetic component 814 (which can be a coil wound around the permanent magnet) can be dynamically activated by the controller during a drop event to momentarily increase the lid attraction force imparted on retention component 302 by adding a second magnetic field to the first field for a predetermined amount of time. The second magnetic field can be generated by drawing a relatively high current from a battery within the charging case (e.g., battery 314) and supplying the current through a magnetic winding around the lid retention magnet under the control of controller. Such an embodiment provides a relatively simple, solid-state and low cost approach to locking the lid during a drop event. In some embodiments, the electromagnet can be activated during the entire time drop event (e.g., period 700 as shown in FIG. 7A). In some other embodiments, however, in order to conserve energy within battery 314, the electromagnet can be instantaneously pulsed for a brief moment (e.g., for 5, 10 or 20 milliseconds) when a hard impact is detected as shown by time periods 710 in FIG. 7B.

2) Mechanical Latch

Figure 9A:
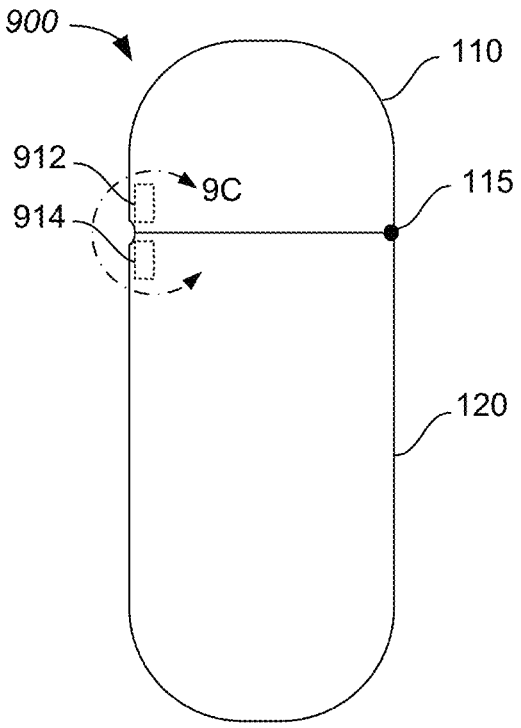
FIG. 9A is a simplified cross-sectional view of a charging case with its lid closed that includes a dynamic latch lid retention mechanism in accordance with some embodiments.
Figure 9C:
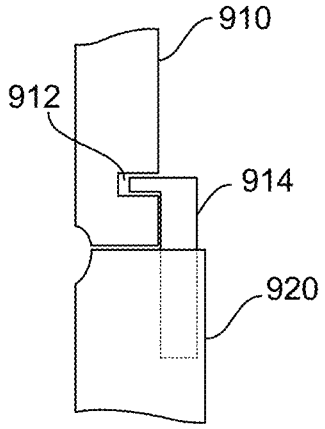
FIG. 9C is a simplified illustration of a latching mechanism according to some embodiments that can dynamically lock the lid of an earbud charging case.
Figure 9B:
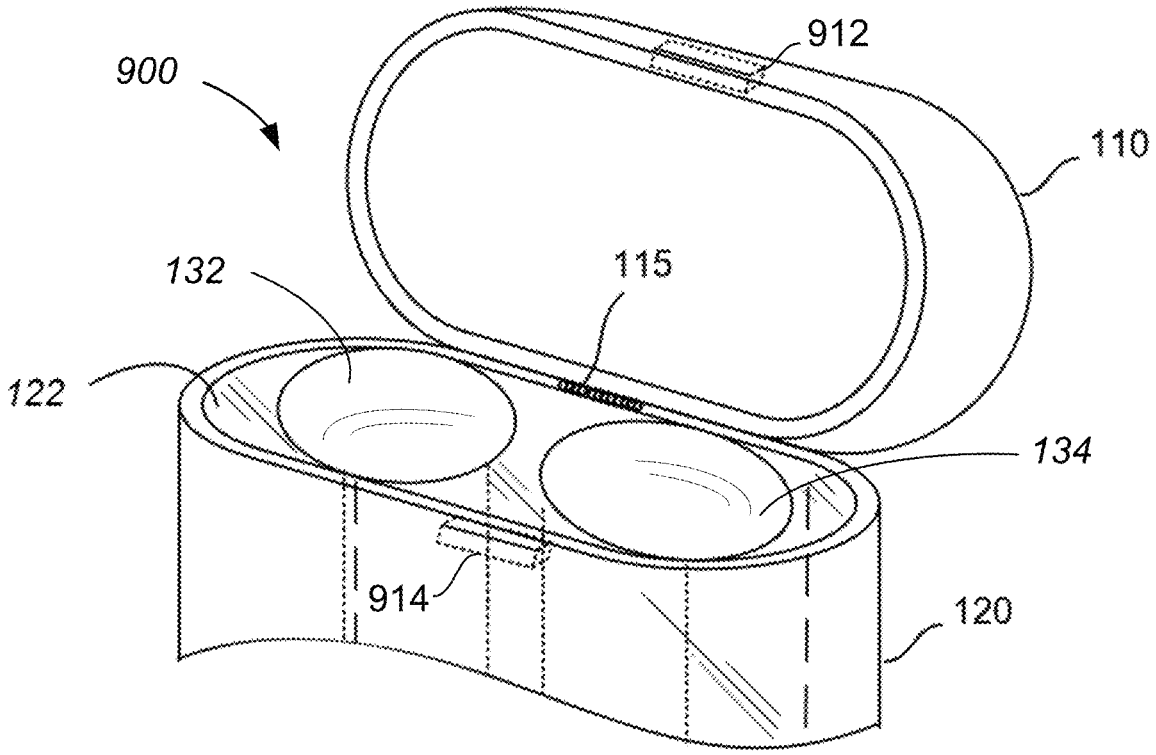
FIG. 9B is a simplified perspective view of a portion of the charging case shown in FIG. 9A with its lid open.

FIG. 9A is a simplified cross-sectional view of a charging case 900 according to some embodiments and FIG. 9B is a simplified partial perspective view of the charging case 900. Charging case 900 can be an implementation of charging case 100 discussed above and, to avoid repetition, various elements of charging case 900 that are similar to those discussed above with respect to other charging cases described herein are labeled with the same reference numbers.

As shown in FIGS. 9A and 9B, charging case 900 can include a lid retention mechanism that includes a first component 912 in the lid 110 and a second component 914 in the body 120. One of the components 912, 914 can be a mechanical latch and the other can be a feature (e.g., a hook or an indentation) that the mechanical latch can latch onto to secure the two components 912, 914 together. For example, component 914 can be a mechanical latch that can be responsive to the trigger signal generated by controller 320 to latch onto component 912, which can be an indentation or hook, and lock lid 110 to body 120. In this manner the latch 914 can physically block or otherwise prevent the lid 110 from opening while the latch 914 is engaged with component 912. Activating latch 914 can be a one-time event that, in some embodiments, requires less current (and thus less battery power) than activating one or more electromagnets as discussed above. The response time of a mechanical latch can be slightly slower than that of an electromagnet, however, so in some embodiments latch 914 can be triggered as soon as freefall is detected and can remain in the latched (locked) state as shown by time period 700 in FIG. 7A until the controller detects that drop event is completed or determines that the freefall event was a false trigger.

FIG. 9C is a simplified cross-sectional illustration of a small portion of a charging case, such as case 900, that includes a mechanical latch 914 that can, in response to a trigger signal, release out of sidewall 920 portion of body 120 and latch onto a notch (first component) 912 formed in a sidewall 910 of lid 110. FIG. 9C shows latch 914 in the activated position such that the latch is engaged with the first component 912 to secure lid 110 in the locked position. The embodiment depicted in FIG. 9C is just one illustrative example of a mechanical latching mechanism that can be incorporated into a charging case according to embodiments of the disclosure. Embodiments of the disclosure are not limited to this one specific example and a person of ordinary skill in the art will recognize many other implementations of mechanical latches that could can lock lid 110 during a drop or impact event based on the disclosure herein.

3) Locking Hinge

Figure 10A:
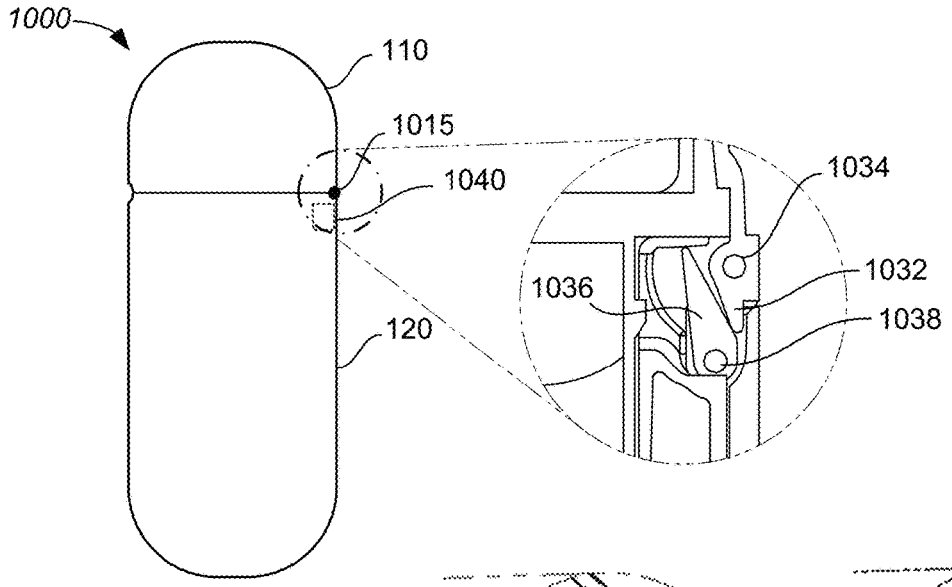
FIG. 10A is a simplified cross-sectional view of a charging case that includes a locking hinge according to some embodiments along with an exploded view of the locking hinge when the lid of the charging case is in a closed position.
Figure 10B:
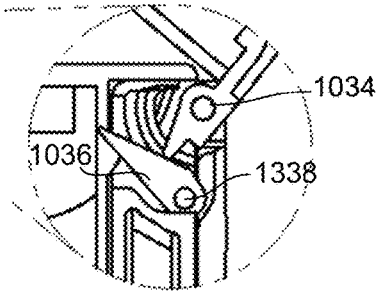
FIG. 10B is a expanded view of the locking hinge of the charging case shown in FIG. 10A with the lid between open and closed positions.
Figure 10C:
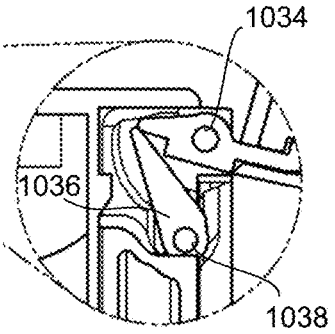
FIG. 10C is a expanded view of the locking hinge of the charging case shown in FIG. 10A with the lid in the open position.
Figure 10D:
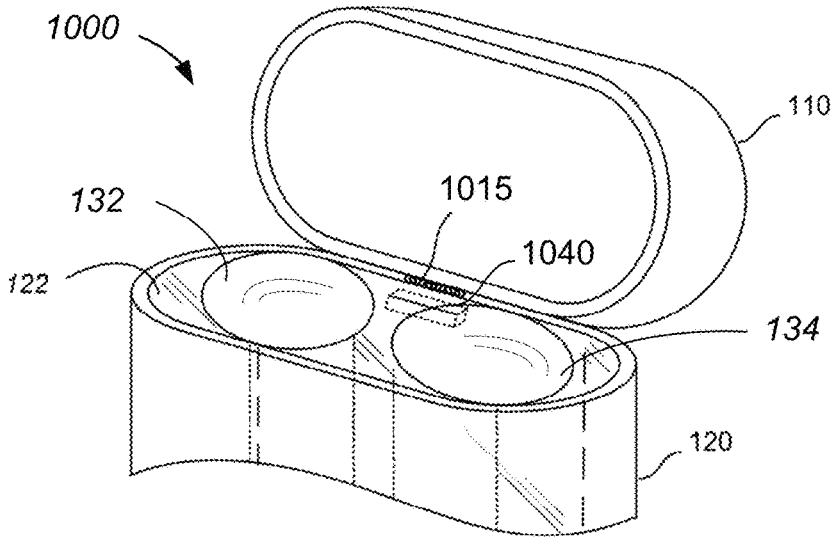
FIG. 10D is a simplified perspective view of a portion of the charging case shown in FIG. 10A with its lid open.

Some embodiments of charging cases according to the present disclosure can include a hinge that can be locked in response to a trigger signal to ensure that the lid remains closed during a drop or similar event. One, non-limiting example of a locking hinge design in accordance with some embodiments is shown in FIG. 10A, which is a simplified cross-sectional view of a charging case 1000 according to some embodiments. Charging case 1000 includes a lid 110 that is pivotably coupled to a body 120 by a hinge 1015. The hinge 1015 can be a spring activated hinge that can provide bi-stable operation of the lid similar to that discussed above. For example, hinge 1015 can have an closed position (illustrated in FIG. 10A) where lid 110 covers the earbud receiving area of body 120 and an open position (illustrated in FIG. 10C) where lid 110 is pivotably displaced from body 120 into a position that allows the earbuds to be removed from charging case 1000. A spring actuated over center mechanism 1030 is shown in more detail in the expanded view portion of FIG. 10A. As shown, lid 110 includes an extension 1032 attached to the lid and disposed on an opposite side of a pivotable joint 1034 from the lid. Thus, when lid 110 rotates about pivotable joint 1034, extension 1032 also rotates about the pivotable joint. Extension 1032 can have a rounded distal end that is in contact with a spring loaded arm 1036 such that the lid resists rotating from the open position to the closed position until the lid is moved past an over center position (illustrated in FIG. 10B) when the lid is then impelled to the open position (illustrated in FIG. 10C). Spring loaded arm 1036 can be attached at a first end to a second pivotable joint 1038 and have a rounded distal tip at its opposite end. A torsion spring (not shown) can impart a rotational force to spring loaded arm 1036 that resists the lid transitioning from the closed position towards the open position.

In accordance with some embodiments of the disclosure, hinge 1015 can include one or more locking mechanisms 1040 that can be activated by controller 320 in response to detecting that the charging case 1000 is in freefall or incurred a hard impact event. For example, on some embodiments locking mechanism 1040 can be an electromagnetic brake that imparts a force on one or both of extension 1032 or spring arm 1036 to prevent either or both of those components from pivoting around pivotable joints 1034, 1038, which in turn, can prevent the lid from opening during an drop event. In other embodiments, the locking mechanism 1040 can include any one or more of the following to prevent lid 110 from opening: one or both of pivotable joints 1034, 1038 can temporarily change shape (e.g., an electrically activated shape memory alloy) in response to a trigger signal which can intentionally bind hinge 1015; hinge 1015 can include a ferrofluid that changes viscosity in response to a trigger signal to impart additional friction on the hinge.

4) Electromagnetic Earbud Lock

Figure 11:
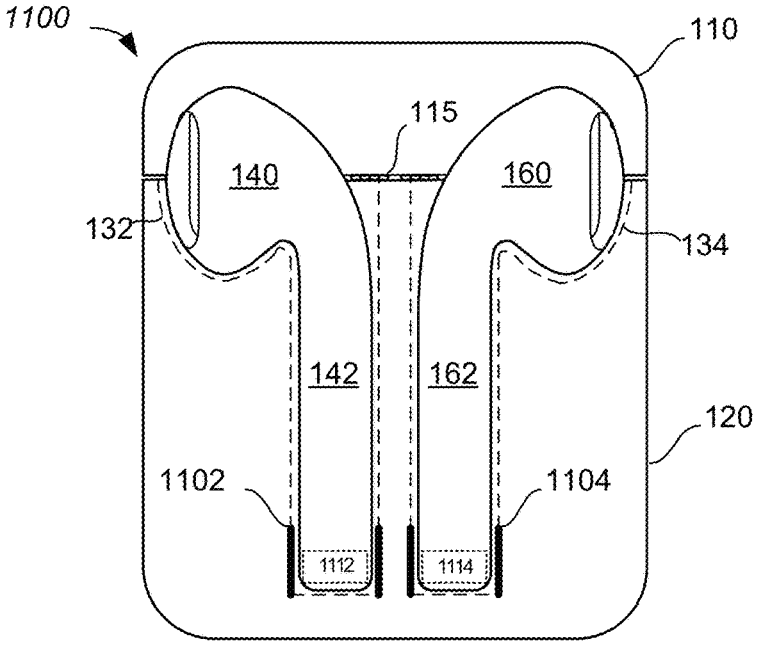
FIG. 11 is a simplified cross-sectional view of a charging case according to some embodiments.

Reference is now made to FIG. 11, which is a simplified cross-sectional view of a charging case 1100 according to some embodiments of the disclosure. Charging case 1100 can be an implementation of charging case 100 and, for ease of discussion, FIG. 11 includes the same references numbers as used in FIGS. 1 and 2 when referring to elements described above with respect to charging case 100. As shown in FIG. 11, charging case 1100 can include a lid 110 that is pivotably coupled to a body 120 by hinge 115. Charging case 1100, and all the charging cases disclosed herein, can be designed such that lid 110 can be opened easily by a user with a light touch when desired but otherwise stay closed.

While not shown in FIG. 1 or 2 charging cases according to various embodiments of the disclosure can include one or more magnets within the body 120 of the charging case that cooperate with magnetic elements in each of the earbuds 140, 160 to magnetically secure the earbuds within their respective pockets or cavities formed within body 120. Such magnets can keep the earbuds 140, 160 in the charging case if, for example, the case is turned upside down when the lid 110 is open. The magnets might not be strong enough, however, to ensure that the earbuds remain in the charging case during a drop event.

Charging case 1100 can include a dynamic earbud retention mechanism that secures the earbuds within the charging case so that the earbuds are not inadvertently dislodged during the event. The dynamic earbud protection mechanism employed in charging case 1100 can be one or more electromagnets that can be activated by controller 320 via the trigger signal to increase the magnetic force that retains the earbuds 140, 160 in case 1100. For example, charging case 1100 can include a first electromagnet 1102 and a second electromagnet 1104 that are aligned with and/or arranged around a portion of earbuds 140, 160, respectively. Electromagnets 1102, 1104 can be strategically placed within charging case 1100 such that, when activated, the magnets generate a magnetic field that attracts magnetic elements (e.g., a magnet, a plate of magnetic material and/or feature of the earbuds made from a magnetic metal, such as electrical contacts) within each earbud, such as magnetic element 1112 in earbud 140 and magnetic element 1114 in earbud 160. The generated magnetic field can add to or otherwise increase the initial magnetic field that retains the earbuds within their pockets to a level that effectively locks the earbuds within the pockets so that they are not dislodged during a drop event even if lid 110 is opened during the event.

Thus, during a drop event, a controller, such as controller 320 (not shown in FIG. 11), within charging case 1100 can detect (or detect a hard impact event) using any of the techniques described above. Upon detecting such an event, the controller can generate a trigger signal that sends a relatively strong current through a magnetic winding around electromagnets 1102 and 1104 creating a first magnetic field between electromagnet 1102 and magnetic element 1112 and a second magnetic field between electromagnet 1104 and magnetic element 1114. In some embodiments, current can be momentarily pulsed to the electromagnets 1102 and 1104 only when an impact event it detected as described above with respect to method 600 and shown graphically in FIG. 7B.

While FIG. 11 depicts electromagnets 1102 and 1104 as encircling a bottom portion of the stems 142 and 162 of earbuds 140, 160, respectively, embodiments of the disclosure are not limited to any particular location or arrangement of the electromagnets. For example, in some embodiments a single electromagnet can be positioned between the two earbuds 140, 160 that, when activated, creates a strong enough magnetic field to interact with magnetic elements within the earbuds and secure both earbuds within the charging case during a drop event. In other embodiments, electromagnets 1102 and 1104 can be positioned near the speaker portion of the earbuds 140, 160 and can, for example, generate a magnetic field that attracts the speaker magnet of each earbud to secure the earbuds within the charging case. Numerous other positions of the electromagnet(s) and/or arrangements are possible.

5) Mechanical Earbud Lock

Figure 12A:
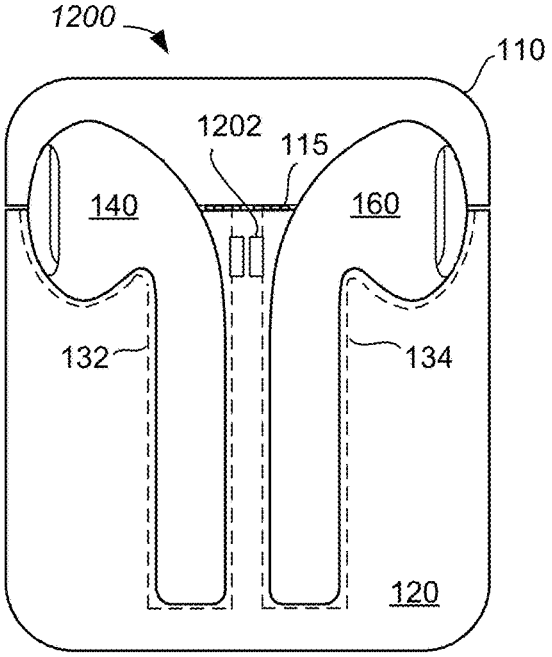
FIG. 12A is a simplified cross-sectional view of a charging case that includes a dynamic earbud retention mechanism according to some additional embodiments.
Figure 12B:
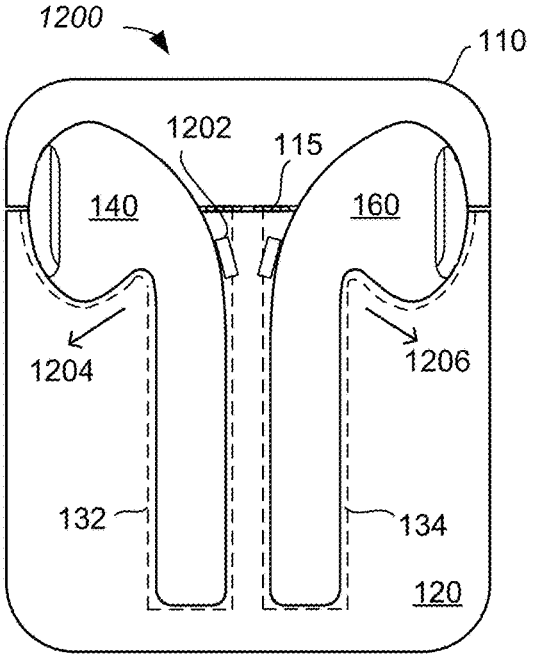
FIG. 12B is a simplified cross-sectional view of the charging case shown in FIG. 12A with the earbud retention mechanism activated.

In still additional embodiments, a dynamic earbud retention mechanism that secures the earbuds within the charging case can be a mechanical mechanism that grabs or otherwise imparts a force on the earbuds to ensure that the earbuds are not dislodged from the charging case during a drop event. FIGS. 12A and 12B are simplified cross-sectional views of a charging case 1200 according to some embodiments of the disclosure. Charging case 1200 can be an implementation of charging case 100 and, for ease of discussion, FIGS. 12A and 12B include the same references numbers as used in FIGS. 1 and 2 when referring to elements described above with respect to charging case 100.

As shown in FIGS. 12A and 12B, charging case 1100 can include a lid 110 that is pivotably coupled to a body 120 by hinge 115. Charging case 1200 can also include a dynamic earbud retention mechanism 1202. FIG. 12A depicts charging case 1200 with the dynamic earbud retention 1202 mechanism in a released or inactive state, while FIG. 12B depicts charging case 1200 with the dynamic earbud retention mechanism 1202 in an engaged or active state.

Dynamic earbud retention mechanism 1202 can include an element that can be activated in response to the trigger signal generated by controller 320 to engage with the housing of each of the earbuds 140, 160. For example, in some embodiments the dynamic earbud retention mechanism can be a spring activated arm or finger that folds into the charging case during normal operation so that the arm or finger does not obstruct the pockets that earbuds 140, 160 fit into and may not even be readily visible within the charging case. If controller 320 detects a drop event or impact event, however, the controller can generate a trigger signal that activates the earbud retention mechanism 1202 such that it extends out of the location in which it normally resides into the pockets or cavities that secure the earbuds 140, 160 within the charging case. When activated, the earbud retention mechanism 1202 can be pressed against a housing of each earbud as shown in FIG. 12B. In some embodiments, earbud retention mechanism 1202 can narrow the opening of the pocket or cavity though which a portion of the earbud is disposed thus physically preventing the earbud from being removed from the charging case until the earbud retention mechanism is deactivated. In some embodiments, earbud retention mechanism 1202 can impart forces 1204, 1206 upon the respective earbuds 140, 160 that presses the earbuds against the inner walls of the pockets or cavities that each earbud is retained in creating sufficient friction between the earbud and the housing of the charging case to secure the earbuds within the charging case during a drop event.

The embodiment depicted in FIGS. 12A and 12B is just one illustrative example of a mechanical earbud retention mechanism that can be incorporated into a charging case according to embodiments of the disclosure. Embodiments of the disclosure are not limited to this one specific example and a person of ordinary skill in the art will recognize many other implementations of mechanical earbud retention mechanisms that can secure earbuds within their storage and charging case during a drop or impact event based on the disclosure herein.

Spatially relative terms, such as "beneath," "below," "lower," "above," "upper" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

The foregoing description, for purposes of explanation, used specific nomenclature to provide a thorough understanding of the described embodiments. However, it will be apparent to one skilled in the art that the specific details are not required in order to practice the described embodiments. For example, while several specific examples of embodiments of the invention described above use measurements from an accelerometer to determine when a charging case is in a freefall state or when it undergoes a sharp impact event, the invention is not limited to analyzing data from an accelerometer to determine such. In other embodiments, other types of sensors can be employed and thus other values of data and other types of data can be relied upon by a controller for such determinations. In some specific embodiments, both acceleration and rotation data can be used to predict or detect freefall or a hard impact event.

As another example, while several embodiments described above included electromagnets as an element that can be activated by a controller to secure the lid of the charging case and/or the earbuds within the charging case, other embodiments can employ electropermanent magnets instead of electromagnets. An electropermanent magnet can be activated by a trigger signal and, once activated, can provide a permanent magnetic force until it is deactivated. Thus, while some embodiments pulse a current to momentarily charge electromagnets during an impact event as shown in FIG. 7B, in other embodiments electropermanent magnets can be used in similar arrangements as the electromagnets but can be activated upon predicting or detecting freefall and then deactivated after the controller determines a drop event is over or was a false event as shown in FIG. 7A. Thus, the foregoing descriptions of the specific embodiments described herein are presented for purposes of illustration and description. They are not target to be exhaustive or to limit the embodiments to the precise forms disclosed. Also, while different embodiments of the invention were disclosed above, the specific details of particular embodiments may be combined in any suitable manner without departing from the spirit and scope of embodiments of the invention. Further, it will be apparent to one of ordinary skill in the art that many modifications and variations are possible in view of the above teachings.

Finally, it is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A charging case for a portable listening device, the charging case comprising:

a body defining a recess for storing the portable listening device;

a lid operably coupled to the body and operable between a closed position where the lid is aligned over the recess covering the portable listening device and an open position that allows a user to remove the portable listening device from the body;

one or more sensors that generate sensor data;

a controller coupled to receive the sensor data from the one or more sensors, the controller operable to: (i) detect an event that can lead to the portable listening device being dislodged from the charging case, and (ii) generate a trigger signal in response to detecting the event; and a portable listening device protection mechanism responsive to the trigger signal and operable to retain the portable listening device within the charging case.

2. The charging case set forth in claim 1 wherein the controller is operable to detect when the charging case is in freefall.

3. The charging case set forth in claim 2 wherein the trigger signal activates the portable listening device protection mechanism and the portable listening device protection mechanism remains activated until the controller detects that a drop event that caused the freefall is over.

4. The charging case set forth in claim 1 wherein the controller is operable to detect when the charging case is subjected to an impact event.

5. The charging case set forth in claim 4 wherein the trigger signal momentarily activates the portable listening device protection mechanism for a predetermined time period.

6. The charging case set forth in claim 1 wherein the portable listening device protection mechanism is operable to lock the lid to the body during the event.

7. The charging case set forth in claim 1 wherein the portable listening device protection mechanism is operable to impart a force on the portable listening device to secure the portable listening device within the recess during the event.

8. The charging case set forth in claim 1 wherein the portable listening device comprises a pair of earbuds and the recess includes a first pocket sized and shaped to accept a left earbud in the pair of earbuds and a second pocket sized and shaped to accept a right earbud in the pair of earbuds.

9. The charging case set forth in claim 1 wherein the portable listening device protection mechanism comprises one or more of an electromagnet, an electropermanent magnet, a mechanical latch or a locking hinge.

10. A charging case for a pair of earbuds, the charging case comprising:

a body having one or more pockets configured to receive the pair of earbuds;

a lid attached to the body and operable between a closed position where the lid is aligned over the one or more pockets covering the pair earbuds and an open position that allows a user to remove the pair of earbuds from the body;

a motion sensor that generates motion sensor data;

a controller coupled to receive the sensor data from the motion sensor, the controller operable to detect when the charging case is in freefall based, at least in part, on the motion sensor data and generate a trigger signal in response to detecting the charging case is in freefall; and an earbud protection mechanism responsive to the trigger signal and operable to retain the pair of earbuds within the charging case.

11. The charging case set forth in claim 10 wherein the earbud protection mechanism is a dynamic lid retention mechanism configured to lock the lid to the body during the freefall event.

12. The charging case set forth in claim 11 wherein the dynamic lid retention mechanism comprises a mechanical latch.

13. The charging case set forth in claim 11 wherein the dynamic lid retention mechanism comprises a locking hinge.

14. The charging case set forth in claim 10 wherein the earbud protection mechanism is a dynamic earbud retention mechanism configured to impart a force on each of the earbuds in the pair of earbuds to secure the earbuds within the cavity during the freefall event.

15. The charging case set forth in claim 14 wherein the dynamic earbud retention mechanism comprises a spring-activated mechanical component.

16. A charging case for a pair of earbuds, the charging case comprising:

a body having one or more cavities configured to receive the pair of earbuds;

a lid attached to the body and operable between a closed position where the lid is aligned over the one or more cavities covering the pair earbuds and an open position that allows a user to remove the pair of earbuds from the body;

a sensor that generates sensor data;

a controller coupled to receive the sensor data from the sensor and operable to detect when the charging case suffers an impact event based, at least in part, on the sensor data and generate a trigger signal in response to detecting the impact event;

an earbud protection mechanism responsive to the trigger signal and operable to retain the pair of earbuds within the charging case.

17. The charging case set forth in claim 16 wherein the earbud protection mechanism is a dynamic lid retention mechanism configured to lock the lid in response to the trigger signal.

18. The charging case set forth in claim 17 wherein the dynamic lid retention mechanism comprises an electromagnet.

19. The charging case set forth in claim 16 wherein the earbud protection mechanism is a dynamic earbud retention mechanism configured to impart a force on each earbud in the pair of earbuds in response to the trigger signal to secure the earbuds within the cavity during the impact event.

20. The charging case set forth in claim 19 wherein the dynamic earbud retention mechanism comprises an electromagnet.

* * * * *